US010624446B2

(12) United States Patent
Cline et al.

(10) Patent No.: US 10,624,446 B2
(45) Date of Patent: Apr. 21, 2020

(54) PAINT BRUSH WITH GROOVED PLUG STRIP

(71) Applicant: The Wooster Brush Company, Wooster, OH (US)

(72) Inventors: Charles L. Cline, Shreve, OH (US); Scott A. Melegari, West Salem, OH (US); Chad T. Mullins, Wooster, OH (US); Michael L. Zimmerman, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 301 days.

(21) Appl. No.: 15/606,234

(22) Filed: May 26, 2017

(65) Prior Publication Data

US 2017/0340098 A1 Nov. 30, 2017

Related U.S. Application Data

(60) Provisional application No. 62/342,247, filed on May 27, 2016.

(51) Int. Cl.
*A46B 9/12* (2006.01)
*A46B 9/02* (2006.01)

(52) U.S. Cl.
CPC ..... *A46B 9/12* (2013.01); *A46B 9/025* (2013.01); *A46B 9/026* (2013.01); *A46B 2200/202* (2013.01)

(58) Field of Classification Search
CPC ..... A46B 9/12; A46B 9/025; A46B 9/026
See application file for complete search history.

(56) References Cited

U.S. PATENT DOCUMENTS

| | | | | |
|---|---|---|---|---|
| 4,027,351 A | | 6/1977 | Marino | |
| 4,253,213 A | | 3/1981 | Marino | |
| 5,483,723 A | * | 1/1996 | Wenzer | A46B 3/02 15/159.1 |
| 6,082,921 A | | 7/2000 | Caldwell | |
| 8,091,172 B2 | | 1/2012 | Cox | |

FOREIGN PATENT DOCUMENTS

WO 2013/012520 1/2013

* cited by examiner

*Primary Examiner* — Shay Karls
(74) *Attorney, Agent, or Firm* — Renner, Otto, Boisselle & Sklar, LLP

(57) ABSTRACT

A brush of the present disclosure includes a handle, a plurality of bristles, and a sleeve configured to couple the plurality of bristles to the handle. A plug strip is disposed within the sleeve and may be configured to orient the plurality of bristles to provide increased coating performance. The plug strip has opposed sides extending along a central longitudinal axis of the plug strip. At least one of the opposed sides has an undulating surface forming tapered ridges alternating with tapered valleys.

17 Claims, 22 Drawing Sheets

PAINT BRUSH WITH GROOVED PLUG STRIP

RELATED APPLICATIONS

This application claims the benefit of U.S. Provisional Application No. 62/342,247 filed May 27, 2016, which is hereby incorporated herein by reference.

FIELD OF INVENTION

The present invention relates generally to brushes, and more particularly to paint brushes with plug strips for retaining and arranging bristles of the paint brushes.

BACKGROUND

Conventional paint brushes have a handle at one end for being gripped by a user, and a plurality of bristles at an opposite end for being placed into a liquid coating, such as paint, stain, adhesive, or the like. The bristles are often retained in a sleeve or ferrule that is crimped or otherwise attached to the handle and adhesively attached or otherwise attached to the bristles. A plug strip may be retained in the sleeve to aid in packing of the plurality bristles and to aid in forming a space or well within the plurality of bristles.

SUMMARY OF INVENTION

According to one aspect of the present invention, a paint brush is provided with a plug strip having opposed sides, where at least one of the opposed sides has an undulating surface with tapered ridges alternating with tapered valleys. This enables one or more advantages, such as a better packing of the plurality of bristles within the sleeve, an increased usable surface area of the bristles, and/or a larger well area within the bristle body of the plurality of bristles. According to a second aspect of the invention, a plug strip is provided on at least one side with an undulating surface formed by ridges alternating with valleys, and the pitch between the valleys is no greater than the pitch between the ridges. According to a third aspect of the invention, a plug strip has opposed sides each having an undulating surface forming ridges alternating with valleys, and the plug strip extends between opposed rounded end portions having a width greater than the spacing between the valleys on opposite sides of the plug strip.

In preferred embodiments, the ridges and/or valleys may be rounded.

More particularly, in accordance with the first aspect of the invention, a brush includes a handle, a plurality of bristles extending from a proximal bristle end region to a distal bristle end region, a sleeve disposed about the proximal bristle end region of the plurality of bristles and configured to couple the plurality of bristles to the handle, and a plug strip disposed within the sleeve and spaced inwardly from the sleeve to form a region in which the proximal bristle end region of the plurality of bristles is retained. The plug strip has opposed sides, and at least one of the opposed sides has an undulating surface forming tapered ridges alternating with tapered valleys in which end portions of the bristles are retained.

In a preferred embodiment, each of the opposed sides has an undulating surface forming tapered ridges alternating with tapered valleys in which end portions of the bristles are retained.

In accordance with the second aspect of the invention, a brush includes a handle, a plurality of bristles extending from a proximal bristle end region to a distal bristle end region, and a sleeve disposed about the proximal bristle end region of the plurality of bristles and configured to couple the plurality of bristles to the handle. A plug strip is disposed within the sleeve and spaced inwardly from the sleeve to form a region in which the proximal bristle end region of the plurality of bristles is retained. The plug strip has opposed sides and at least one of the opposed sides has an undulating surface forming ridges alternating with valleys in which end portions of the bristles are retained. Along at least one of the opposed sides, a pitch between the valleys is no greater than a pitch between the ridges.

In a preferred embodiment, both of the opposed sides have an undulating surface forming ridges alternating with valleys in which end portions of the bristles are retained, and wherein a pitch between the valleys is no greater than a pitch between the ridges at both of the opposed sides.

In accordance with the third aspect of the invention, a brush includes a handle, a plurality of bristles extending from a proximal bristle end region to a distal bristle end region, and a sleeve disposed about the proximal bristle end region of the plurality of bristles and configured to couple the plurality of bristles to the handle. A plug strip is disposed within the sleeve and spaced inwardly from the sleeve to form a region in which the proximal bristle end region of the plurality of bristles is retained. The plug strip has opposed sides each having an undulating surface forming ridges alternating with valleys in which end portions of the bristles are retained. The plug strip extends between opposed rounded end portions each having a width greater than spacing between the valleys on opposite sides of the plug strip.

In accordance with a fourth aspect of the invention, a plug strip is provided for being spaced inwardly from a sleeve of a brush to form a region in which bristle end regions of a plurality of bristles may be retained. The plug strip includes opposed sides each having an undulating surface forming ridges alternating with valleys in which end portions of the bristles may be retained. The plug strip is characterized by at least one of the additional features of (a) the ridges and valleys being tapered, (b) along at least one of the opposed sides a pitch between the valleys being no greater than a pitch between the ridges, or (c) the plug strip extending between opposed rounded end portions each having a width greater than spacing between the valleys on opposite sides of the plug strip.

Embodiments of the invention may have one or more of the following features:

- the ridges or the valleys may be rounded.
- the opposed sides extend along a central strip longitudinal axis of the plug strip, and the valleys may have widths along the central strip longitudinal axis that become progressively smaller in a direction from a location at one half depth of the valleys inwardly towards the central strip longitudinal axis.
- a width of the valleys at a bottom of the valleys near the central strip longitudinal axis may be less than a width of the valleys at one half depth of the valleys.
- the opposed sides extend along a central strip longitudinal axis of the plug strip, and the alternating ridges and the valleys may extend fully along the opposed sides along the central strip longitudinal axis.

the plug strip may include opposed top and bottom surfaces, and the alternating ridges and valleys may extend fully between the opposed top and bottom surfaces.

the brush may include a central brush longitudinal axis extending from the proximal bristle end region to the distal bristle end region, and a full outer periphery of the plug strip extending about the central brush longitudinal axis may be radially inwardly spaced from a radially inner surface of the sleeve disposed about the plug strip.

the brush may include a central brush longitudinal axis extending from the proximal bristle end region to the distal bristle end region, and the ridges and valleys may extend along and align with the central brush longitudinal axis.

the ridges may be equally spaced from one another.

a lower edge of the sleeve may be disposed between the distal bristle end region and the plug strip.

where both of the opposed sides have an undulating surface forming ridges alternating with valleys in which end portions of the bristles are retained, crests of the ridges of one of the opposed sides may be aligned opposite crests of the ridges of the other of the opposed sides.

the plug strip may extend along the central strip longitudinal axis between opposed lateral ends of the plug strip, and each of the opposed lateral ends may form a single rounded ridge extending outwardly from the opposed sides.

the plug strip may be a first plug strip and the brush may further include a second plug strip disposed within the sleeve and spaced inwardly from the sleeve, the second plug strip disposed parallel to and spaced from the first plug strip, the second plug strip has opposed sides, and at least one of the opposed sides of the second plug strip may have an undulating surface forming tapered ridges alternating with tapered valleys in which end portions of the bristles are retained.

the first and second plug strips each may have a radially outer opposed side that faces away from the other of the first and second plug strips, and the radially outer opposed side of each of the first and second plug strips may have the undulating surface.

The foregoing and other features of the invention are hereinafter described in greater detail with reference to the accompanying drawings.

BRIEF DESCRIPTION OF THE DRAWINGS

The annexed drawings, which are not necessarily to scale, show various aspects of the disclosure.

DETAILED DESCRIPTION

The principles of the present disclosure have particular application to paint brushes, but are also applicable to brushes for application of any liquid. The principles are also applicable to other brushes having bristles, such as for application of or use with liquid/solid mixtures.

Figure 1:
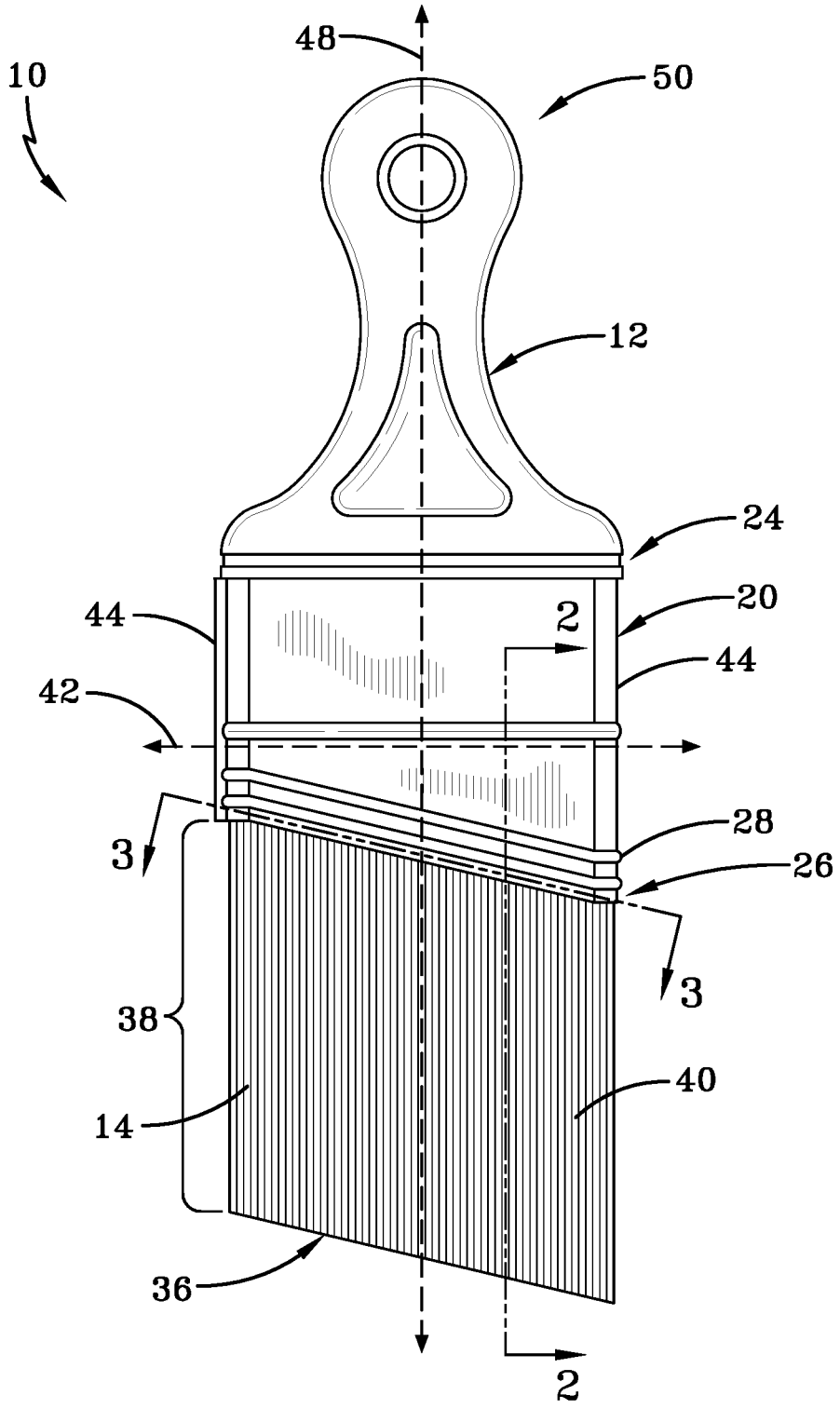
FIG. 1 is a side elevation view of an exemplary paint brush in accordance with the present invention.
Figure 2:
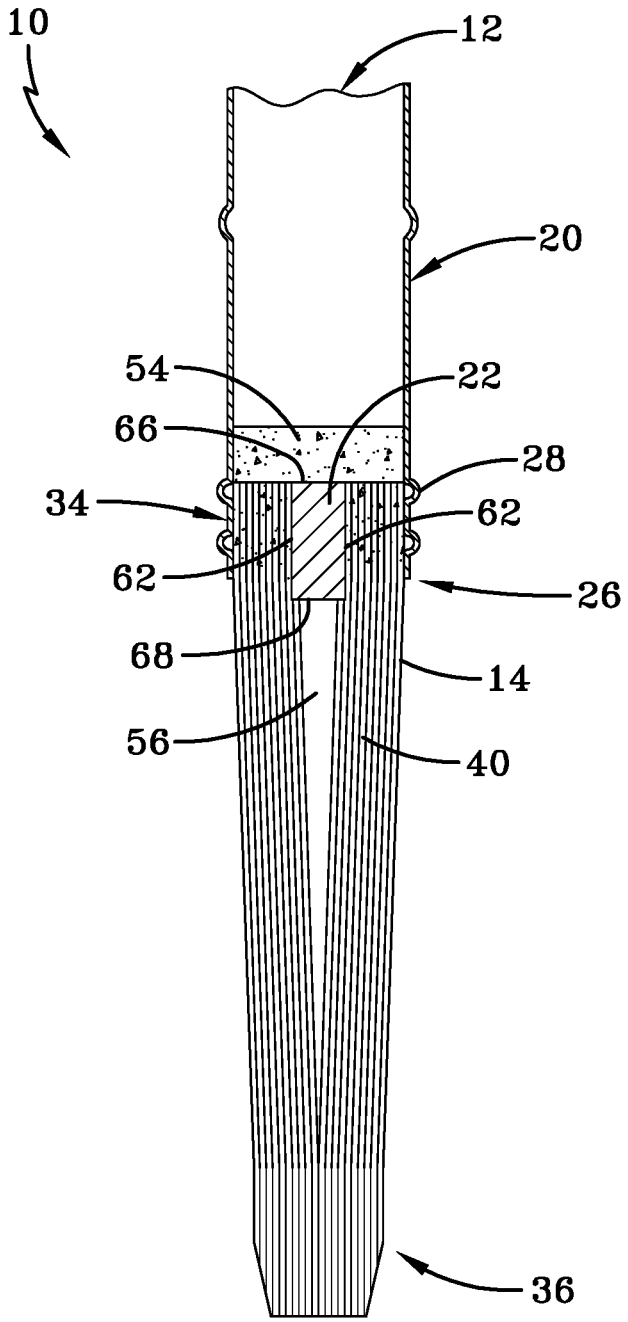
FIG. 2 is a cross-sectional view through the brush of FIG. 1, showing an exemplary plug strip in accordance with the invention.
Figure 3:
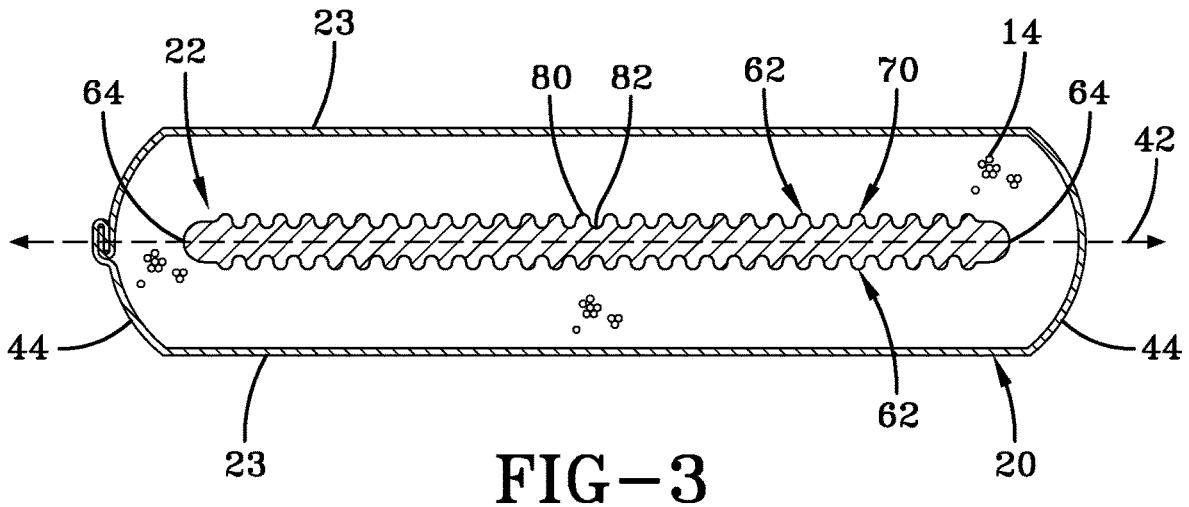
FIG. 3 is another cross-sectional view through the brush of FIG. 1, showing the plug strip.
Figure 4:
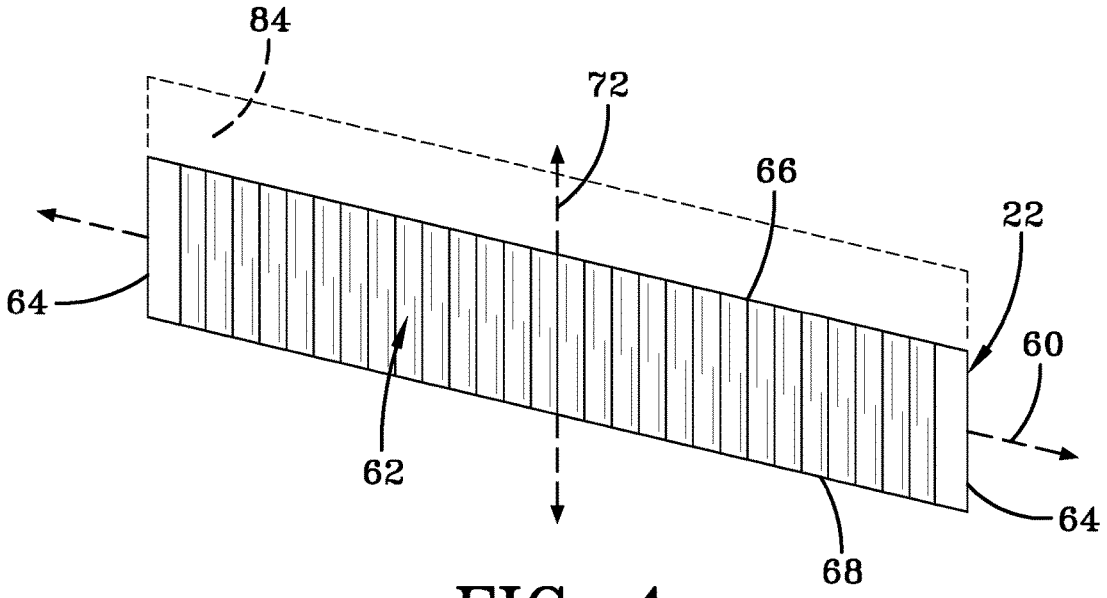
FIG. 4 is a side elevational view of the plug strip of the brush of FIG. 1.

Referring first to FIGS. 1-3, a paint brush 10 in accordance with the present disclosure includes a handle 12 and a plurality of bristles 14 for being placed into a quantity of liquid coating for being applied to another surface (not shown). As used herein, the plurality of bristles 14 may be made of any suitable material, and may include, for example, natural material, fully or partially synthetic material, or any suitable combination thereof. A sleeve, such as a ferrule 20, is configured to couple the bristles 14 and the handle 12 to one another. A plug strip 22 is disposed at least partially within the ferrule 20 and is configured to aid in packing of the plurality of bristles 14.

The handle 12 is generally configured for being held by a user, such as being shaped for being gripped by a user's hand. The handle 12 is made of a flexible plastic, although the handle 12 may be made of a rigid plastic, metal, wood, or combination thereof in other embodiments.

The ferrule 20 extends from a proximal end 24 of the handle 12 to a distal end 26 of the ferrule 20. The depicted ferrule 20 is attached to the handle 12 by crimping, though adhesive or fasteners, for example, may be used in some embodiments. In other embodiments, the ferrule 20 may not be separately formed from the handle 12 and may be integral with the handle 12. The ferrule 20 may include one or more outwardly protruding grooves 28. The ferrule 20 is composed of metal, although other materials may be suitable.

The ferrule 20 includes opposed sides 23 extending between opposed lateral ends 44. The cross-sectional shape of the ferrule 20 defined by the opposed sides 23 and opposed lateral ends 44 may be any suitable cross-sectional shape for retaining the plurality of bristles 14 and one or more plug strips 22. As depicted in FIG. 3, for example, the illustrated opposed sides 23 are generally flat and are aligned parallel to one another and to a central brush lateral axis 42 that extends between opposed lateral ends 44 of the ferrule 20. The opposed lateral ends 44 are outwardly curved in opposing directions from one another. In other embodiments, the opposed sides 23 and opposed lateral ends 44 may have any other suitable respective shapes and additionally or alternatively may be otherwise suitably oriented relative to one another.

The illustrated ferrule 20 is disposed about a proximal bristle end region 34 of the plurality of bristles 14 to aid in confining and retaining a shape of a body 38 of the plurality of bristles 14. The plurality of bristles 14, also herein referred to as the bristles 14, extend from the proximal bristle end region 34 received within the ferrule 20 to a distal bristle end region 36 opposite the proximal bristle end region 34. The bristles 14 may be made of any suitable material.

An exposed length 38 of the bristle body 40 includes the distal bristle end region 36 and is defined as the portion of the bristle body 40 that is not contained within the ferrule 20. The width of the bristle body 40 extends laterally across the brush 10, along the central brush lateral axis 42. Distal tips of the exposed length 38 may be angled or aligned at a bias to the central brush lateral axis 42 in an angled brush, as shown in FIG. 1. In other embodiments, such as in a straight brush, distal tips may be aligned parallel to the central brush lateral axis 42.

A central brush longitudinal axis 48 of the brush 10 extends orthogonally to the central brush lateral axis 42, between a distal end 50 of the handle 12 and the distal bristle end region 36. In the depicted embodiment, the central brush lateral axis 42 and the central brush longitudinal axis 48 intersect. The handle 12 may be otherwise aligned in other embodiments, such as set at a bias to the central brush longitudinal axis 48.

Turning generally to FIGS. 2-6, in the illustrated embodiment, the plug strip 22 is disposed at an angle relative to the central brush lateral axis 42, as the illustrated brush 10 is an angled brush. A central strip longitudinal axis 60 extends at an angle with respect to the central brush lateral axis 42. In the depicted embodiment, each of the central brush lateral axis 42 and the central strip longitudinal axis 60 are aligned in the same plane, such as the central plane 84 bisecting the plug strip 22 between the opposed sides 62 and extending along the central brush longitudinal axis 48.

It will be appreciated that in other embodiments, such as where the respective brush is not an angled brush, the plug strip 22 may not be disposed at an angle relative to the central brush lateral axis 42. In such case, the central brush lateral axis 42 and the central strip longitudinal axis 60 may be disposed parallel one another.

Turning particularly to FIGS. 2 and 3, as is conventional, the bristles 14 are set in a suitable adhesive, such as an epoxy 54, within the confines of the ferrule 20. The epoxy 54 extends into one or more of the outwardly protruding grooves 28 of the ferrule 20 for securely fastening the bristles 14 to the ferrule 20, and thus to the handle 12. In other embodiments, a different adhesive may be used, or the adhesive may be omitted altogether where suitable.

It can be seen that the plug strip 22 is disposed within the ferrule 20. The plug strip 22 is also disposed within the proximal bristle end region 34 confined in the ferrule 20, and is spaced inwardly from the ferrule 20 to form a region in which the proximal bristle end region 34 of the plurality of bristles 14 is retained. As shown, the plug strip 22 is partially disposed in the epoxy 54, though may not be disposed in the epoxy 54 in other embodiments.

Because the bristles 14 are packed between the plug strip 22 and the ferrule 20, at least some of the bristles 14 and the plug strip 22 define a well area 56. The well area 56 is a void within the bristle body 40 for retaining liquid coating when the brush 10 is dipped or otherwise placed into liquid coating. At least part of the well area 56 is disposed in the exposed length 38 of the bristle body 40. During use for coating, the liquid coating in the well area 56 is directed along the lengths of the bristles 14 for being applied to the another surface (not shown).

The plug strip 22 may extend beyond the ferrule 20, into the exposed length 38. In other embodiments, the distal end 26 of the ferrule 20 may be disposed between the plug strip 22 and the distal bristle end region 36.

The plug strip 22 includes a top surface 66 and a bottom surface 68. As will be appreciated, the top surface 66 is shown nearer the proximal end 24 of the handle 12, while the bottom surface 68 is shown nearer the distal end 26 of the ferrule 20.

Indications of top and bottom are made with reference to the orientation of the brush 10 shown in the accompanying figures. It will be appreciated that the brush 10 could be oriented in numerous other orientations.

As will be appreciated, the plug strip 22 can be formed by extrusion and cut to a discrete thickness. In such case, the top and bottom surfaces 66 and 68 may be planar and parallel to one another, as illustrated in FIG. 2, for example. In other embodiments, the respective top and bottom surfaces 66 and 68 need not be planar and or parallel to one another. In such cases, the plug strip 22 can otherwise be formed, such as in whole or in part by injection molding, machining, etc.

Extending between the top and bottom surfaces 66 and 68, an outer periphery 70 of the plug strip 22 includes opposed sides 62 that extend between opposed lateral ends 64, also extending between the top and bottom surfaces 66 and 68. The outer periphery 70 is disposed about a central strip lateral axis 72 that extends between the top and bottom surfaces 66 and 68. The outer periphery 70 is fully radially inwardly spaced from a radially inner surface of the ferrule 20.

The opposed sides 62 extend in a longitudinal (strip) direction along the central strip longitudinal axis 60. At least one of the opposed sides 62 includes an undulating surface forming ridges 80 alternating with valleys 82. As preferably shown, each of the opposed sides 62 includes an undulating surface having alternating ridges 80 and valleys 82.

The ridges 80 extend outwardly towards the ferrule 20, such as outwardly relative to the central plane 84 bisecting the plug strip 22 between the opposed sides 62. The valleys 82, also herein referred to as grooves, extend inwardly away from the ferrule 20, such as inwardly towards the central plane 84. Proximal end portions 34 of the bristles 14 are retained in the valleys 82.

Additional details of the opposed lateral ends 64 and of the opposed sides 62 are particularly illustrated in FIGS. 4-7, showing the plug strip 22 separate from the brush 10.

Referring in detail first to the opposed lateral ends 64, the lateral ends 64 are rounded end portions. One or both of the lateral ends 64 may have an end width 86 greater than a valley spacing width 88 between valleys 82 on opposite sides of the plug strip 22. In one embodiment, the end width 86 may be measured at a base portion 89 of the lateral ends 64 abutting the ridges 80 and valleys 82 of the opposed sides 62.

The lateral ends 86 may lack grooves or valleys. For example, a full periphery of at least one of the opposed lateral ends 64, between the top and bottom surface 66 and 68 and disposed about the central brush longitudinal axis 48 (FIG. 1), may extend radially outwardly towards the ferrule 20 (FIG. 3). This provides a plug strip lateral end 64 with a round surface or a single rounded ridge for corresponding with an adjacent round inner surface of the ferrule 20 at the respective lateral end 44 of the ferrule 20.

Referring next in detail to the opposed sides 62, the alternating ridges 80 and valleys 82 extend fully across the opposed sides 62, such as along directions parallel to the central strip longitudinal axis 60. As shown, each of the undulating surfaces ends at a ridge 80 adjacent the opposed lateral ends 64.

Either end of either undulating surface may end at a valley 82 in other embodiments. Additionally, in other embodiments, one or more of the ridges 80 and valleys 82 may extend less than fully across the opposed sides 62.

In the illustrated embodiment, the ridges 80 and the valleys 82 also extend fully along the opposed sides 62, such as in directions transverse the central strip longitudinal axis 60 and along the central strip lateral axis 72. For example, in a direction extending between the top and bottom surfaces 66 and 68, the ridges 80 and valleys 82 of at least one of the opposed side 62 extend fully between each of the top and bottom surfaces 66 and 68.

It will be appreciated that where the plug strip 22 is disposed at an angle, the valleys 82 of both of the opposed sides 62 may be disposed at a bias, such as relative to the central strip longitudinal axis 60. In this way the valleys 82, and the ridges 80, align with the central brush longitudinal axis 48. The bristles 14 may accordingly be packed into the valleys 82 and also aligned with the central brush longitudinal axis 48.

Figure 5:
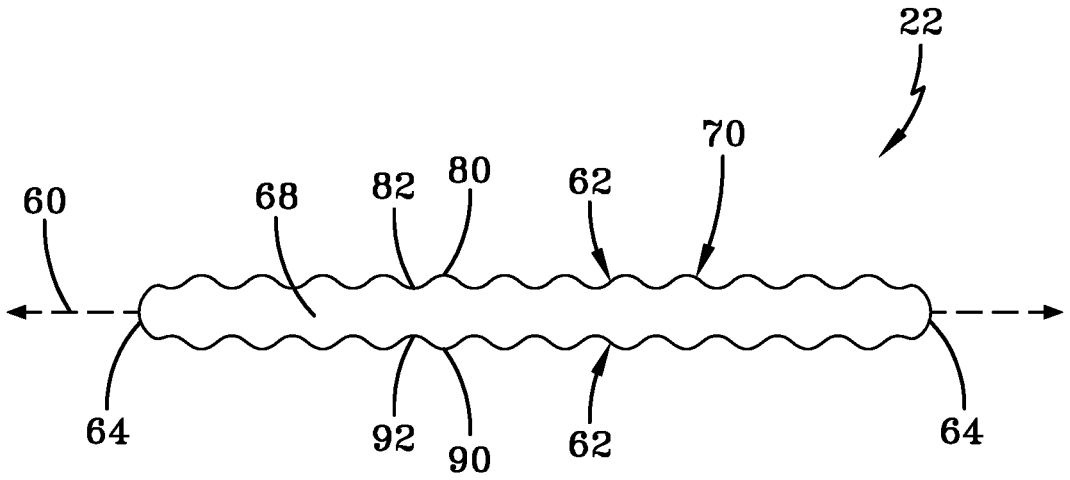
FIG. 5 is a bottom view of the plug strip of the brush of FIG. 1.
Figure 6:
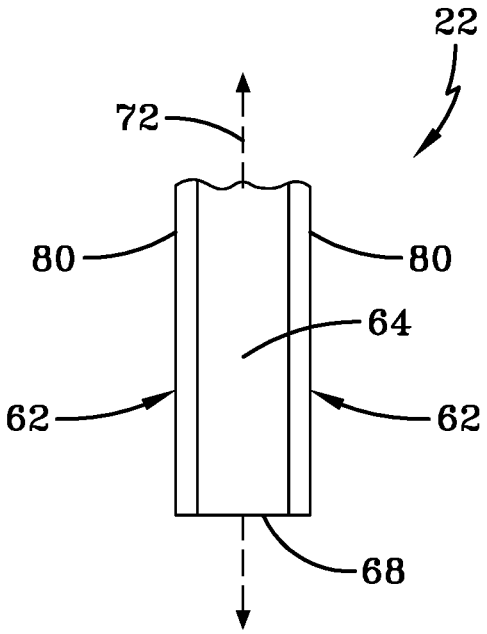
FIG. 6 is an end elevational view of the plug strip of the brush of FIG. 1.

Looking specifically to FIG. 5, the alternating ridges 80 and valleys 82 of at least one of the opposed sides 62, and of both of the opposed sides 62 in the present embodiment, are tapered.

More particularly, the ridges 80 may be progressively tapered along at least part of the distance from respective crests 90 of the ridges 80 to respective roots 92 of the valleys 82, and preferably, along the full respective distance, as shown. Likewise, the valleys 82 may be progressively tapered along at least part of the distance from respective roots 92 of the valleys 82 to respective crests 90 of the ridges 80, and preferably, along the full respective distance, as shown.

Figure 7:
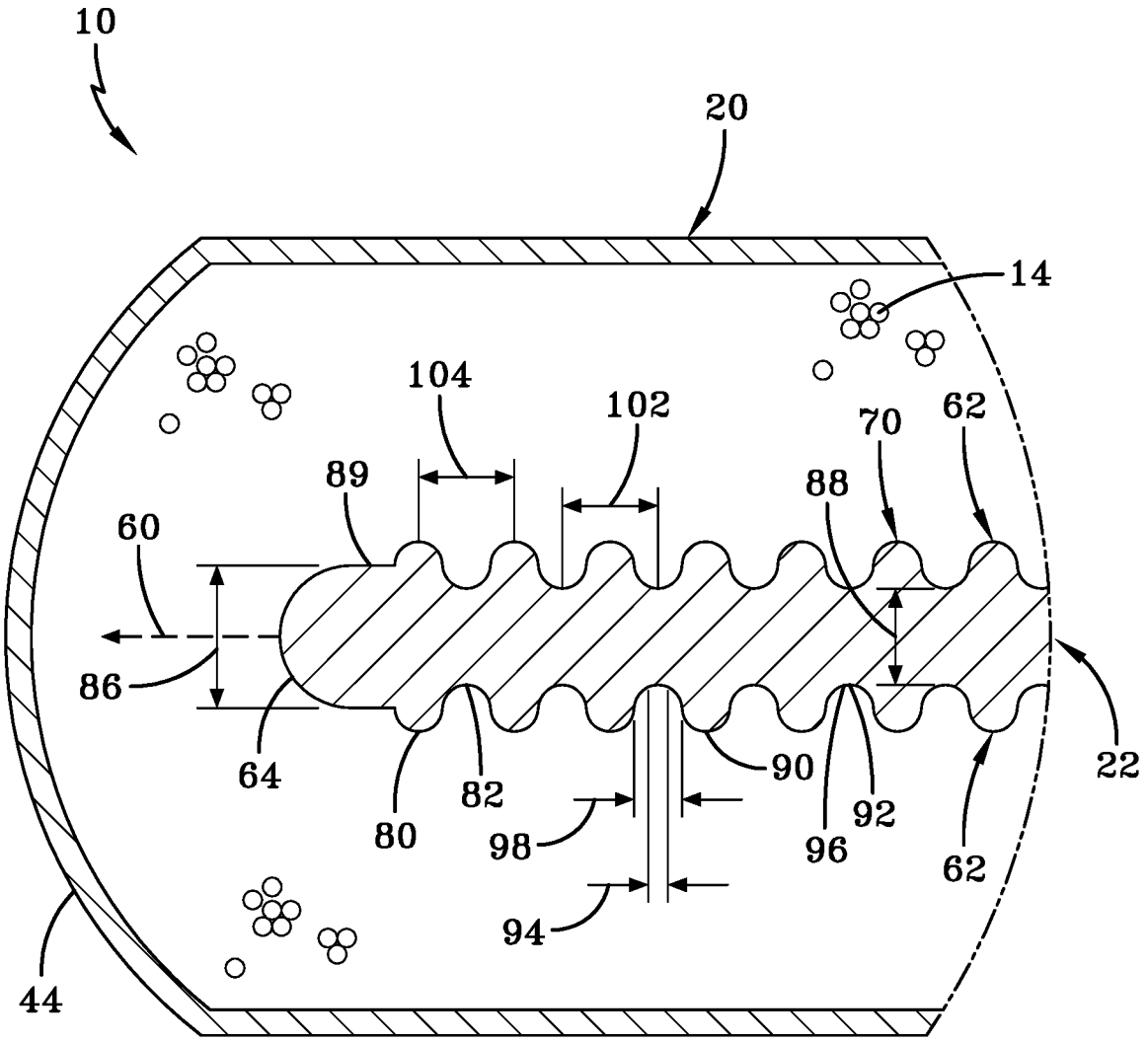
FIG. 7 is an enlarged cross-sectional view of FIG. 3, showing the plug strip.

Turning now specifically to FIG. 7, even more details of the plug strip 22 are shown. Along at least one of the opposed sides 62, widths of the valleys 82 along the central strip longitudinal axis 60 may become progressively smaller. This progression may extend from a location at one half depth of the valleys 82 inwardly towards the roots 92 of the valleys 82. In other words, this progression is directed inwardly towards the central strip longitudinal axis 60.

For example, in a preferred embodiment, a width 94 of the valleys 82 at a bottom 96 of the valleys 82, near the central strip longitudinal axis 60, may be less than a width 98 of the valleys 82 at one half depth of the valleys 82, medially between the crests 90 and roots 92. It will be appreciated that as used herein, depth refers to a direction extending from the crests 90 to the roots 92.

In the illustrated embodiment, the ridges 80 and the valleys 82 of at least one of the opposed sides 62 may be rounded, and preferably of both of the opposed sides 62. In other embodiments, less than all of the ridges 80 and the valleys 82 of one or both of the opposed sides 62 may be rounded.

In a preferred embodiment, along at least one of the opposed sides 62, a pitch 102 between the valleys 82 may be no greater than a pitch 104 between the ridges 80. In other words, the pitch 104 between the ridges, may be no less than the pitch 102 between the valleys.

In a preferred embodiment, the ridges 80 along at least one of the opposed sides 62 may be equally spaced from one another.

In some embodiments, such as shown in FIG. 7, the valleys 82 along at least one of the opposed sides 62, additionally or alternatively, may be equally spaced from one another.

In some embodiments, along at least one of the opposed sides 62, and along both opposed sides 62 in the illustrated embodiment, the pitch 102 between the valleys 82 may be equal to the pitch 104 between the ridges 80.

In some embodiments, across the central strip longitudinal axis 60, the ridges 80 of one of the opposed sides 62 may be aligned with the ridges 80 of the other of the opposed sides 62. In other words, crests 90 of the ridges 80 of each of the opposed sides 62 may be aligned with one another.

In some embodiments, additionally or alternatively, the valleys 82 of each of the opposed sides 62 may be aligned with one another. In other words, roots 92 of the valleys 82 of each of the opposed sides 62 may be aligned with one another.

For example, the illustrated embodiment of FIG. 7 includes opposed sides 62 that are mirror images of one another, with respect to the central plane 84 bisecting the mirrored sides 62.

Other embodiments may include ridges and/or valleys that are not equally spaced from one another. Other embodiments may include crests and/or roots that are not aligned with one another.

With respect to the illustrated alternating arrangement of the ridges 80 and the valleys 82, the plug strip 22 and the brush 10 are configured to provide one or more benefits. For example, the geometry of the plug strip 22 may provide increased coating performance of a surface to be coated (not shown) by the brush 10. For example, the ridges 80 and the valleys 82 may be shaped and aligned relative to one another to orient the plurality of bristles 14 to provide one or more of (a) an increased usable surface area of bristles 14, (b) a better packing of the plurality of bristles 14 within the ferrule 20, and (c) a larger well area 56 within the bristle body 40 (FIG. 2).

One or more of these benefits may provide increased coating performance by enabling coating, such as paint, to be efficiently distributed from the well area 56 of the brush 10 to the distal bristle end region 36 of the plurality of bristles 14. This may provide consistent coating application across the width of the bristle body 40 of the plurality of bristles 14.

Figure 8:
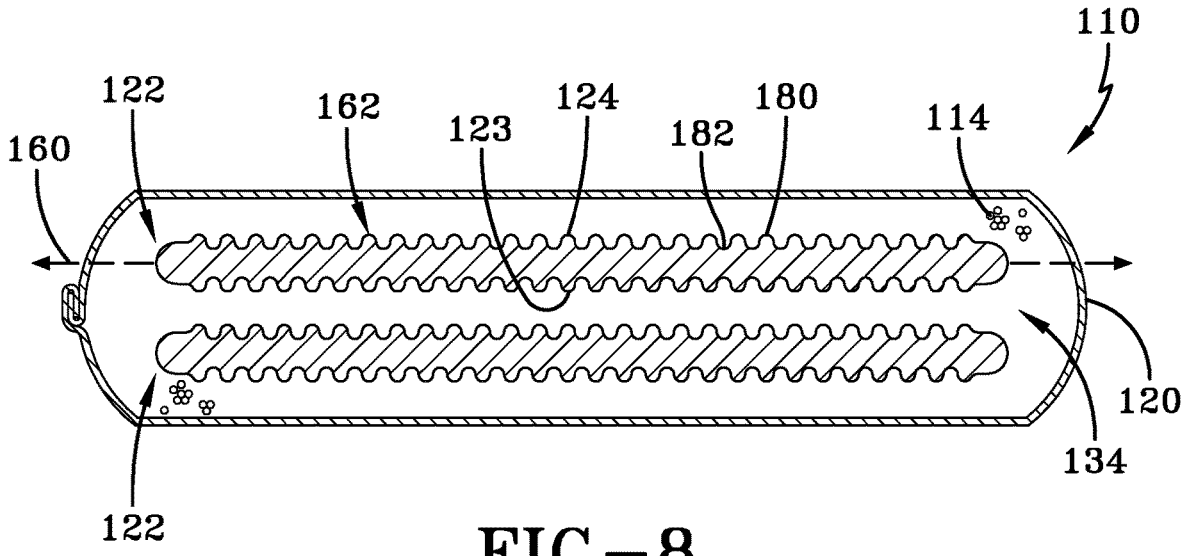
FIG. 8 is a cross-sectional view through another exemplary brush in accordance with the invention, showing a pair of exemplary plug strips in accordance with the invention.
Figure 9:
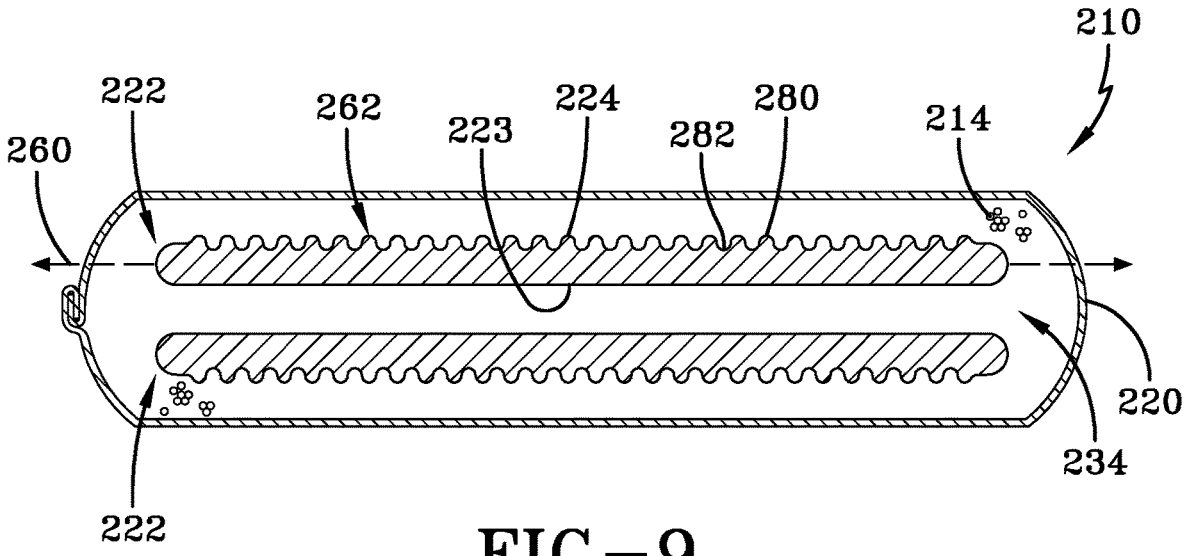
FIG. 9 is another cross-sectional view through another exemplary brush in accordance with the invention, showing a pair of exemplary plug strips in accordance with the invention.

Turning now to FIGS. 8 and 9, further embodiments of brushes are shown cross-sectionally at 110 (FIG. 8) and at 210 (FIG. 9). Like the brush 10 of FIGS. 1-7, the brush 110 includes a handle (not shown) and a plurality of bristles 114 contained in a sleeve 120 attached to the handle. The brush 210 also includes a handle (not shown), and a plurality of bristles 214 contained in a sleeve 220 attached to the handle. Different from the brush 10, the brushes 110 (FIG. 8) and 210 (FIG. 9) each include a pair of plug strips 122 (FIG. 8) or 222 (FIG. 9) that are disposed within the respective sleeve 120 (FIG. 8) or 220 (FIG. 9).

Referring specifically to the brush 110 of FIG. 8, the pair of plug strips 122 is disposed within a proximal bristle end region 134 of the plurality of bristles 114. Each of the plug strips 122 of the pair includes opposed sides including radially inner sides 123 and radially outer sides 124. At least each of the radially inner sides 123 has an undulating surface of ridges and valleys. More particularly, as illustrated, each of the radially inner sides 123 and the radially outer sides 124 may have an undulating surface of ridges and valleys. Bristles 114 are packed between each of the plug strips 122 and between each of the plug strips 122 and an inner surface of the sleeve 120. For example, bristles 114 may be packed into the valleys at the radially inner sides 123 and at the radially outer sides 124 of the of the plug strips 122 of the pair.

In other embodiments, it will be appreciated that the undulating surfaces of the radially outer sides 124 may be omitted.

Referring now to the brush 210 of FIG. 9, the pair of plug strips 222 is disposed within a proximal bristle end region 234 of the plurality of bristles 214. Different from the brush 110 of FIG. 8, each of the plug strips 222 of the pair in the brush 210 of FIG. 9 includes only a radially outer side 223 having an undulating surface of ridges and valleys. A radially inner side 224 of each of the plug strips 222 of the pair does not include an undulating surface. The bristles 214 are aligned between the plug strips 222 and between each of the plug strips 222 and an inner surface of the sleeve 220. Bristles 214 are packed into the valleys at the radially outer sides 223 of the of the plug strips 222 of the pair.

With respect to either of the embodiments of FIGS. 8 and 9, any of the radially inner sides and radially outer sides of each of the two plug strips may include an undulating surface. For example, one plug strip may have both opposed sides having an undulating surface while another plug strip may have only a radially inner side or a radially outer side having an undulating surface.

While two plug strips 122 (FIG. 8) or 222 (FIG. 9) are shown, any suitable number of plug strips may be included in other embodiments. One or more plug strips may not extend fully along other plug strips in some embodiments. One or more plug strips may not be identical to other plug strips in some embodiments. One or more plug strips may be aligned at a bias relative to one more other plug strips. While the respective ridges and valleys of the opposed sides 123 (FIG. 8) or 223 (FIG. 9) of the plug strips 122 (FIG. 9) or 222 (FIG. 9) are aligned with one another and equally sized, other sizes and alignments may be suitable.

Figure 10:
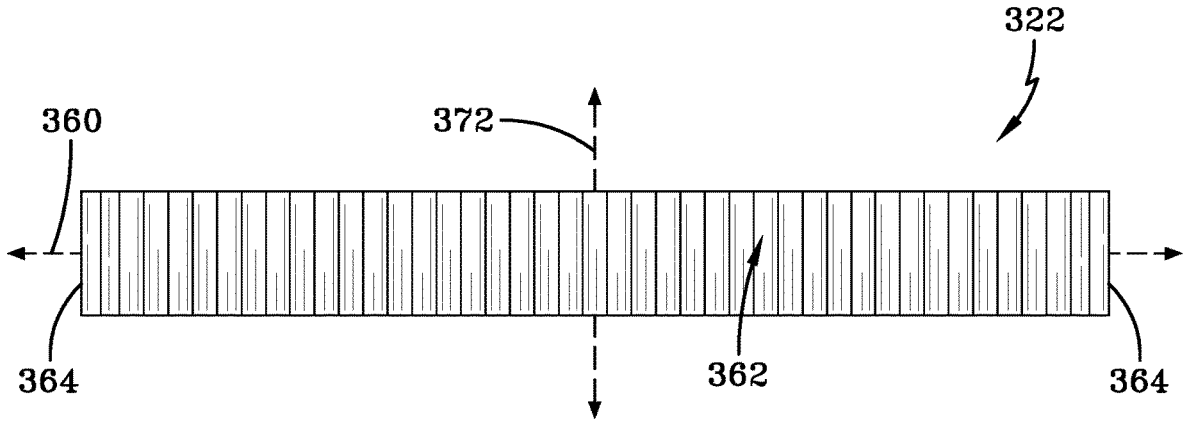
FIG. 10 is a side elevational view of another exemplary plug strip in accordance with the invention.
Figure 11:
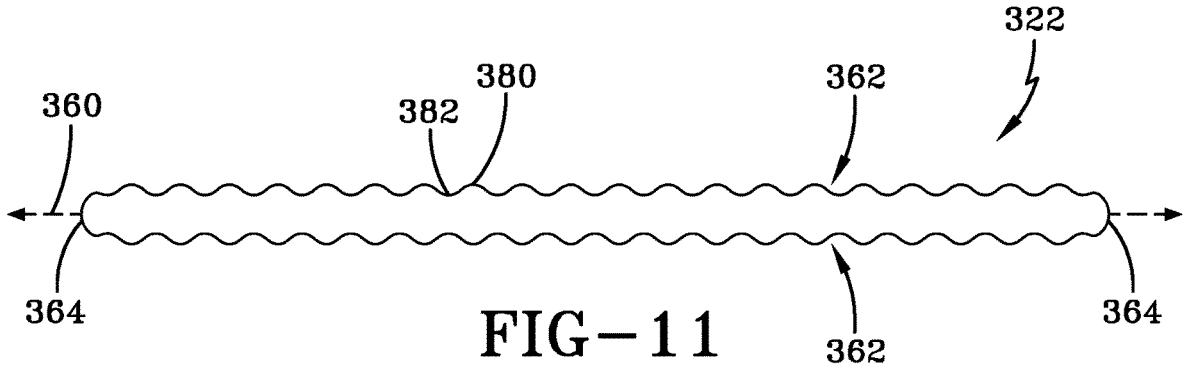
FIG. 11 is a bottom view of the plug strip of FIG. 10.
Figure 12:
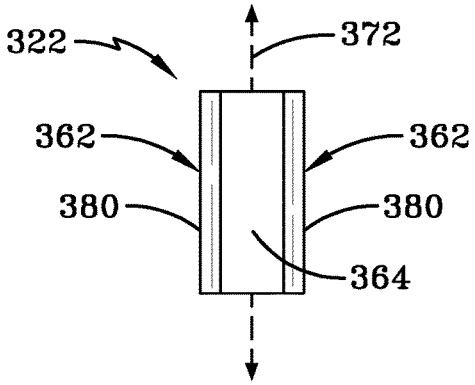
FIG. 12 is an end elevational view of the plug strip of FIG. 10.

Turning next to FIGS. 10-12, a further embodiment of a plug strip is shown at 322. The plug strip 322 may be used with a brush, such as a straight brush, different from the angled brush of FIGS. 1 and 2. Like the plug strip 22, the plug strip 322 includes opposed sides 362 extending between opposed lateral ends 364, where each of the opposed sides has an undulating surface defining alternating ridges 380 and valleys 382. Different from the plug strip 20, the ridges 380 and 382 of the plug strip 322 are aligned orthogonal to the central strip longitudinal axis 360 and parallel the central strip lateral axis 372.

Turning generally to FIGS. 13-21, additional embodiments of plug strips are shown. Like the plug strip 22, each of the plug strips of the FIGS. 13-21 includes at least one opposed side, and preferably both opposed sides, having an undulating surface defining alternating ridges and valleys. Like the plug strip 322 of FIGS. 10-12, the plug strips of FIGS. 13-21 are shaped for best use with a straight brush.

Figure 13:
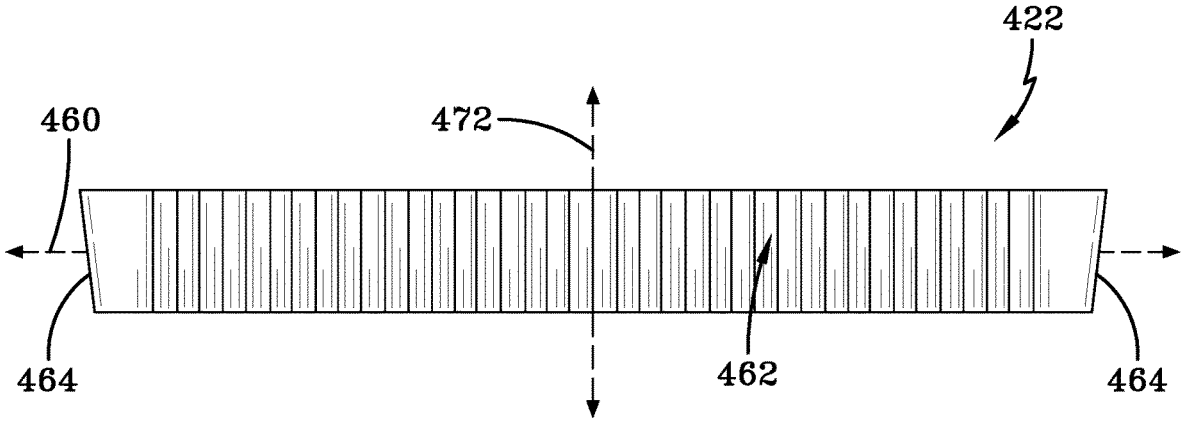
FIG. 13 is a side elevational view of yet another exemplary plug strip in accordance with the invention.
Figure 14:
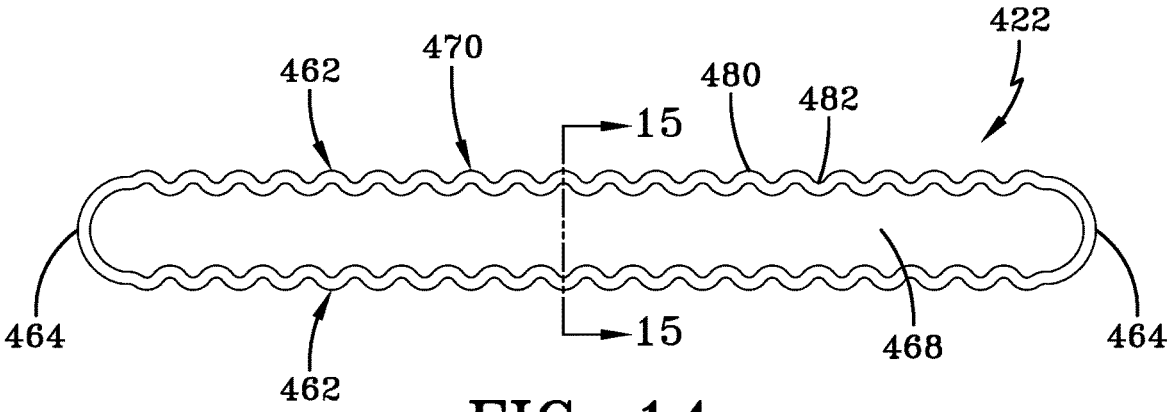
FIG. 14 is a bottom view of the plug strip of FIG. 13.
Figure 15:
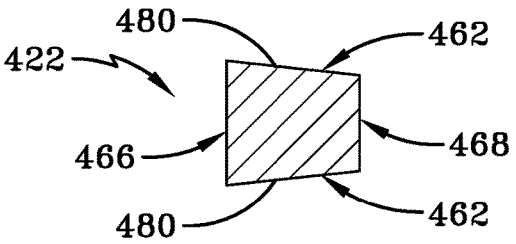
FIG. 15 is a cross-sectional view through the plug strip as shown in FIG. 14.

Referring first to FIGS. 13-15, an embodiment of a plug strip is shown at 422. The outer periphery 470 of the plug strip 422 tapers outwardly, such as radially outwardly away from a central strip lateral axis 472. For example, the opposed sides 462 and opposed lateral ends 464 of the plug strip 422 taper progressively outwardly in a direction from a bottom surface 468 to a top surface 466. As such the bottom surface 468 has a smaller surface area than the top surface 466. The ridges 480 and valleys 482, in part defining the outer periphery 470 about the central strip lateral axis 472, also taper progressively outwardly in a direction from the bottom surface 468 to the top surface 466.

Figure 16:
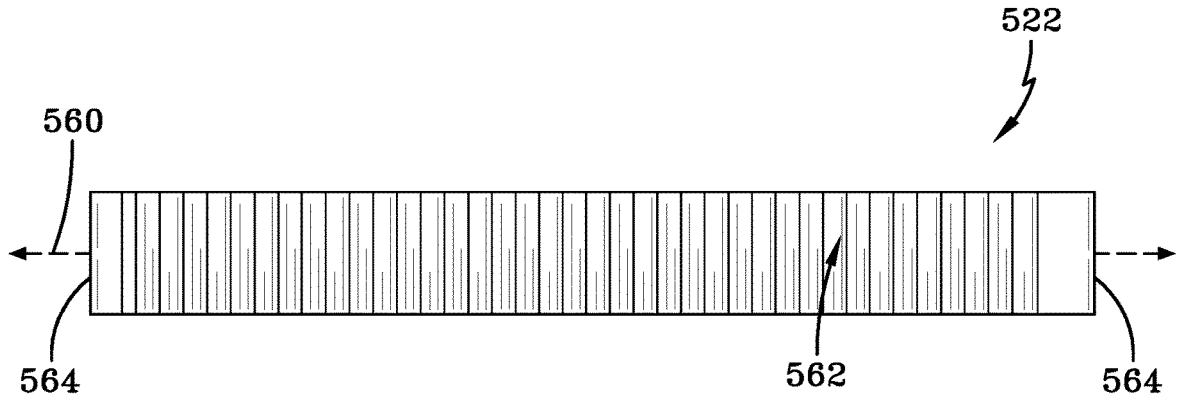
FIG. 16 is a side elevational view of still another exemplary plug strip in accordance with the invention.
Figure 17:
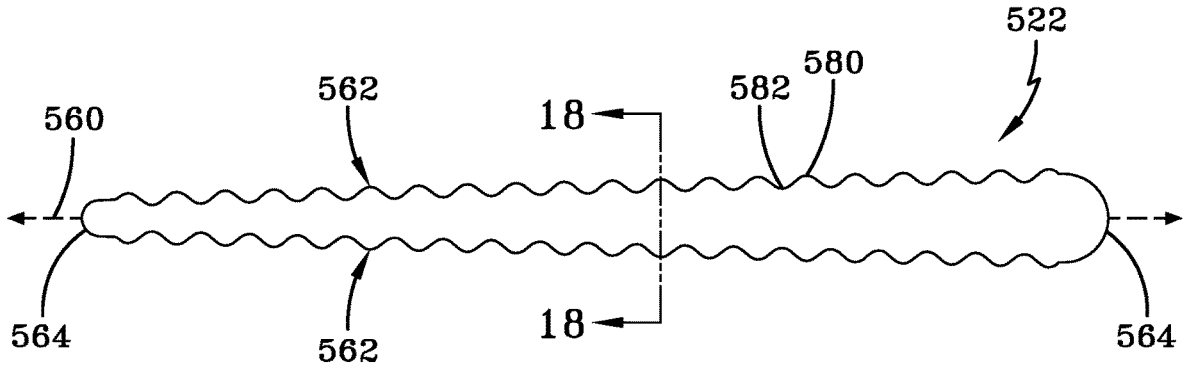
FIG. 17 is a bottom view of the plug strip of FIG. 16.
Figure 18:
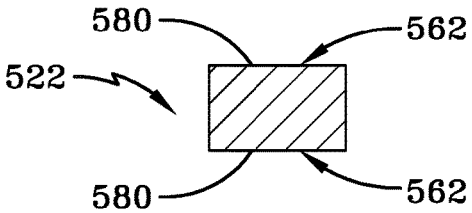
FIG. 18 is a cross-sectional view through the plug strip as shown in FIG. 17.

Turning next to FIGS. 16-18, another embodiment of a plug strip is shown at 522. The plug strip 522 includes opposed sides 562 that taper progressively outwardly from a central strip longitudinal axis 560 in a direction from one opposed lateral end 564 to the opposite lateral end 564.

Figure 19:
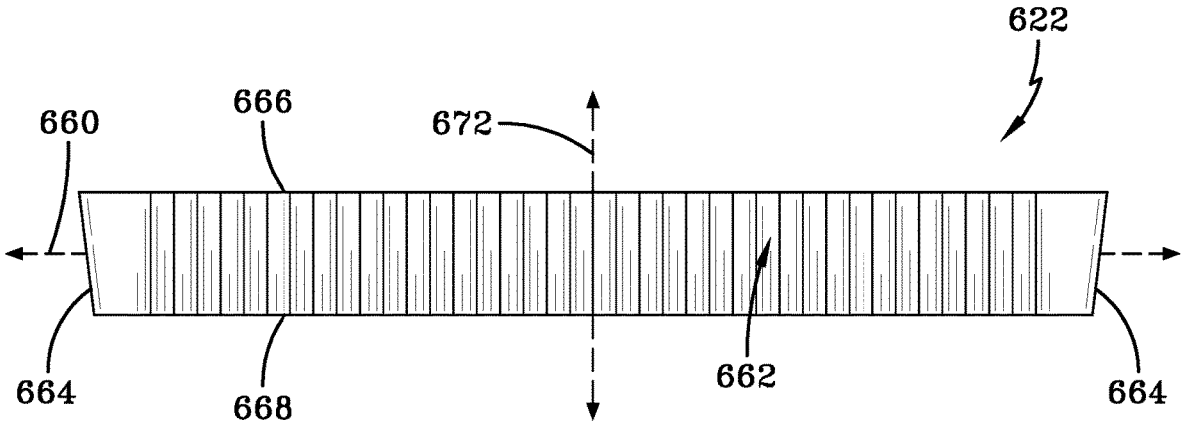
FIG. 19 is a side elevational view of a further exemplary plug strip in accordance with the invention.
Figure 20:
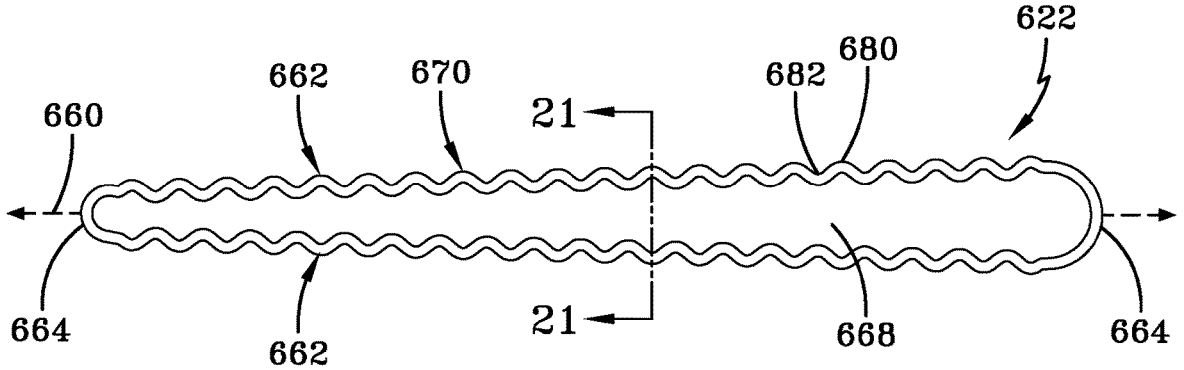
FIG. 20 is a bottom view of the plug strip of FIG. 19.
Figure 21:
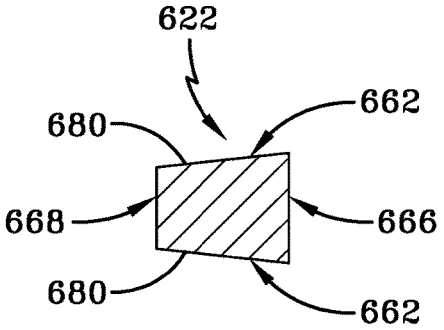
FIG. 21 is a cross-sectional view through the plug strip as shown in FIG. 20.
Figure 22:
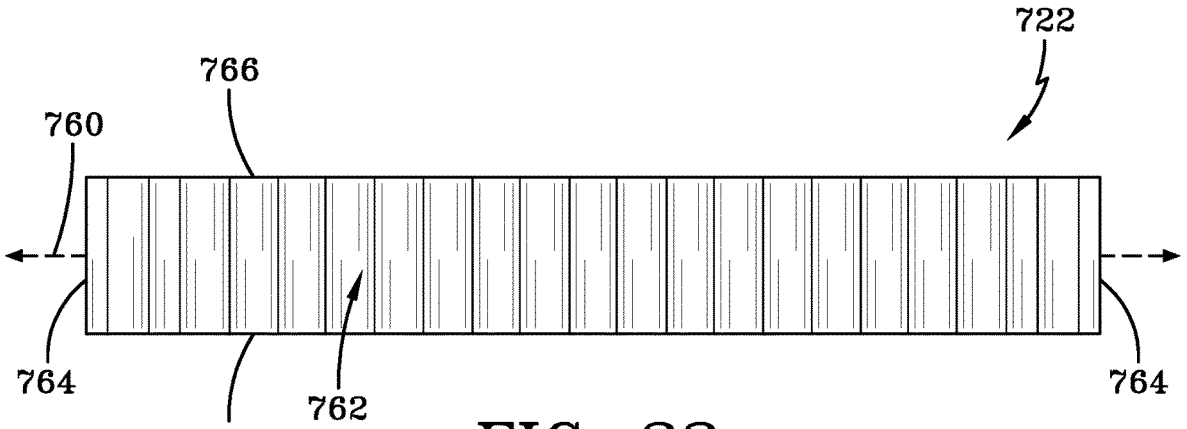
FIG. 22 is a side elevational view of another exemplary plug strip in accordance with the invention.
Figure 23:
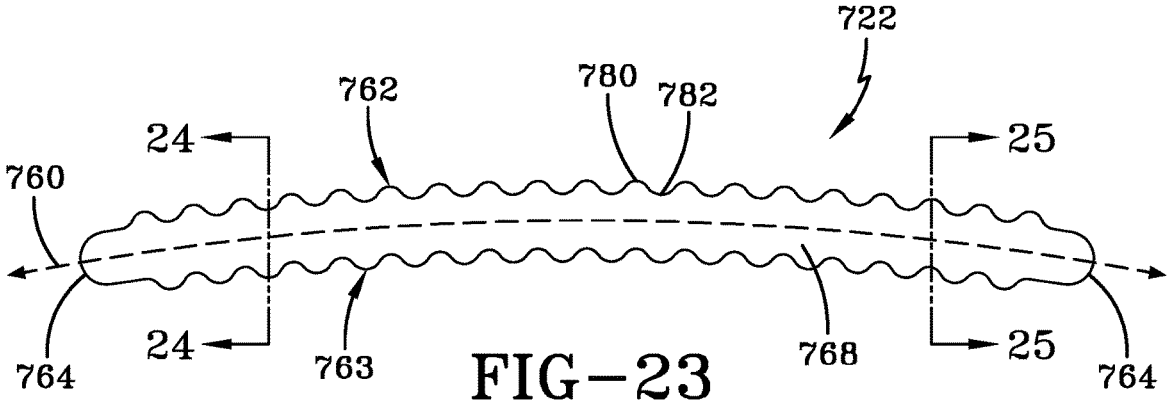
FIG. 23 is a bottom view of the plug strip of FIG. 22.
Figure 24:
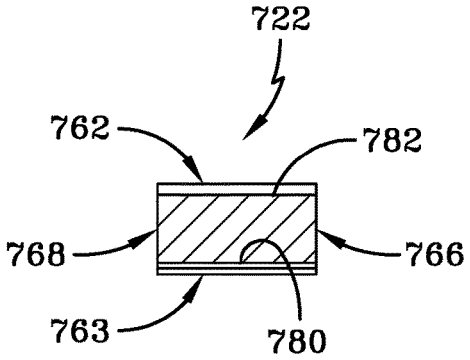
FIG. 24 is a cross-sectional view through the plug strip as shown in FIG. 23.
Figure 25:
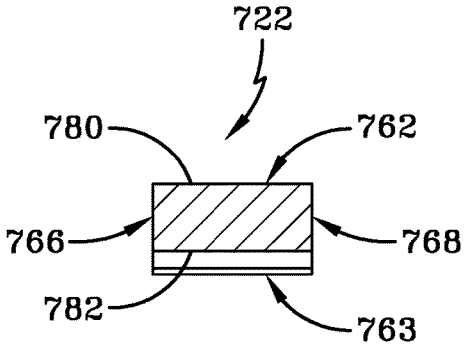
FIG. 25 is another cross-sectional view through the plug strip as shown in FIG. 23.

Referring next to FIGS. 19-21, still another embodiment of a plug strip is shown at 622. The plug strip 622 includes an outer periphery 670 that tapers outwardly, such as progressively outwardly from a central lateral strip axis 672, in a direction from a bottom surface 668 to a top surface 666. Additionally, the opposed sides 662 taper outwardly, such as progressively outwardly from a central strip longitudinal axis 660, in a direction from one opposed lateral end 664 to the opposite lateral end 664.

It will be appreciated that the tapered features of the plug strips 422, 522 and 622 are equally applicable to plug strips for use with an angled brush. In even other embodiments, a full outer periphery of a plug strip may not be tapered. For example, one or more but not all of the opposed sides and opposed lateral ends of a plug strip may be tapered in a direction between a top and bottom surface and/or in a direction between opposed lateral ends.

Turning generally to FIGS. 22-51, further embodiments of plug strips and respective ferrules are depicted. Like the plug strip 22, each of the plug strips of the FIGS. 22-51 includes at least one opposed side, and preferably both opposed sides, having an undulating surface defining alternating ridges and valleys. Like the plug strip 322 of FIGS. 10-12, the plug strips of FIGS. 22-51 are shaped for best use with a straight brush.

Different than depicted with respect to the previously described embodiments, each of the plug strip embodiments depicted in FIGS. 22-51 is shown in use with a ferrule having non-flat opposed sides extending between opposed lateral ends of the ferrule, for example as compared to the ferrule 20 of FIG. 3 having generally flat opposed sides 23. It will be appreciated, however, that any of the plug strip embodiments described herein may be sized for use with ferrules of different shapes, such as the ferrule 20 or the generally-elliptically-shaped ferrule 720 of FIG. 26, to be described further below.

Referring first to FIGS. 22-26, an embodiment of a plug strip is shown at 722. The plug strip 722 includes opposed sides 762 and 763 extending between opposed lateral ends 764, where each of the opposed sides has an undulating surface defining alternating ridges and valleys. The plug strip 722 is curved and thus has a curved central strip long axis 760 extending between the opposed lateral ends 764. Each of the curved sides 762 and 763 is curved in the same direction. The ridges and valleys alternate along the curved central strip long axis 760 and extend orthogonal to the central strip long axis 760 between opposed top and bottom surfaces 766 and 768 of the plug strip 722.

Figure 26:
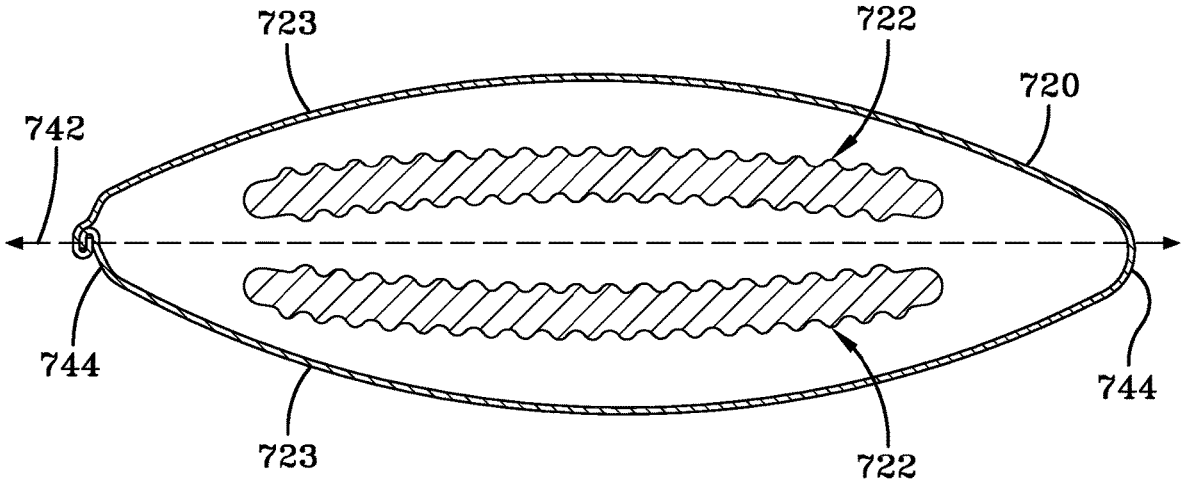
FIG. 26 is a cross-sectional view through an exemplary brush including a pair of exemplary plug strips as shown in FIGS. 22-25.
Figure 27:
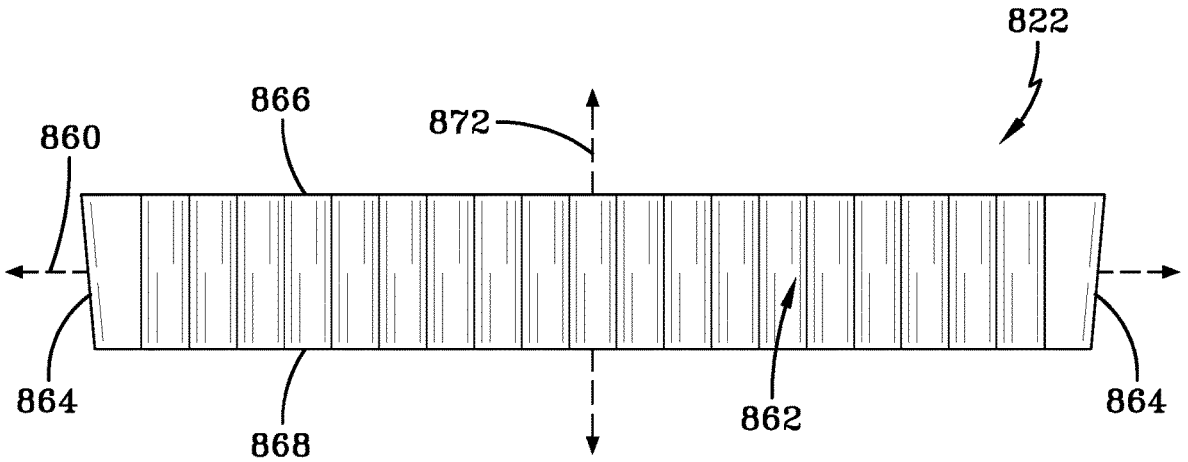
FIG. 27 is a side elevational view of another exemplary plug strip in accordance with the invention.
Figure 28:
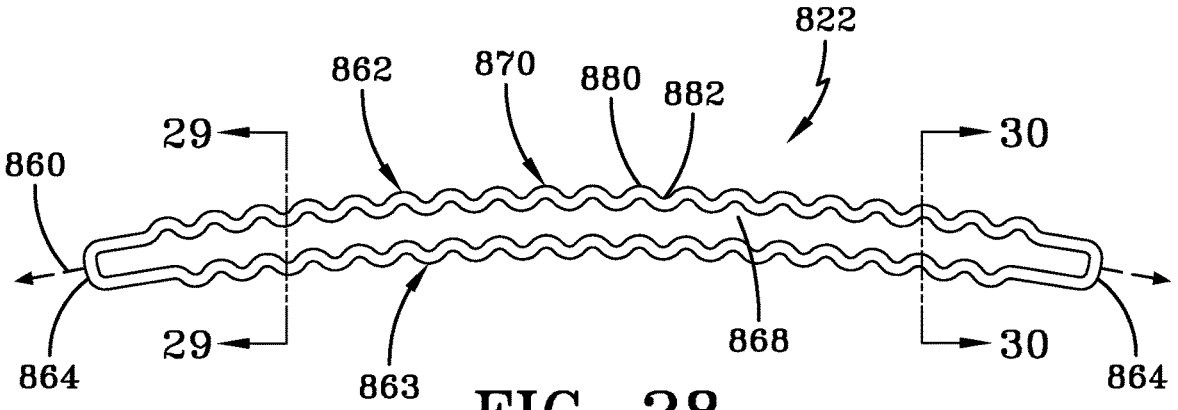
FIG. 28 is a bottom view of the plug strip of FIG. 27.
Figure 29:
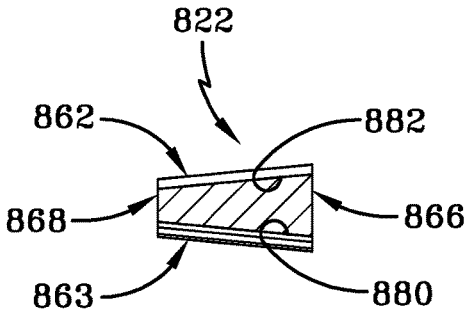
FIG. 29 is a cross-sectional view through the plug strip as shown in FIG. 28.
Figure 30:
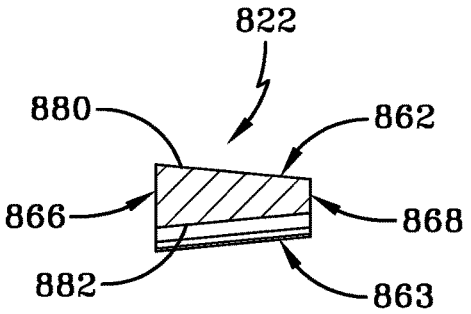
FIG. 30 is another cross-sectional view through the plug strip as shown in FIG. 28.

FIG. 26 depicts a pair of curved plug strips 722 arranged in a ferrule 720 disposed opposite one another and extending along a respective ferrule central longitudinal axis 742. In view of the curved shape of the plug strips 722, each point along the curved central strip long axis 760 is not equidistant from the ferrule central longitudinal axis 742. The plug strips 722 are curved in opposite directions relative to one another. In other embodiments, the plug strips may be curved in the same direction. The depicted ferrule 720 has oppositely curved opposed sides 723 that extend between curved opposed lateral ends 744. The opposed sides 723 and opposed lateral ends 744 define an elliptical cross-sectional shape of the ferrule 720.

Turning next to FIGS. 27-31, an embodiment of a plug strip is shown at 822. Like the plug strip 722 of FIGS. 22-26, the plug strip 822 is curved and thus has a curved central strip axis 860 extending between opposed lateral ends 864. The plug strip 822 is further substantially similar to the plug strip 722, except that the outer periphery 870 of the plug strip 822 tapers outwardly, such as radially outwardly away from a central strip longitudinal axis 872. For example, the opposed sides 862 and 863 and the opposed lateral ends 864 of the plug strip 822 taper progressively outwardly in a direction from a bottom surface 868 to a top surface 866. As such the bottom surface 868 has a smaller surface area than the top surface 866. The ridges 880 and valleys 882, in part defining the outer periphery 870 about the central strip lateral axis 872, also taper progressively outwardly in a direction from the bottom surface 868 to the top surface 866.

Figure 31:
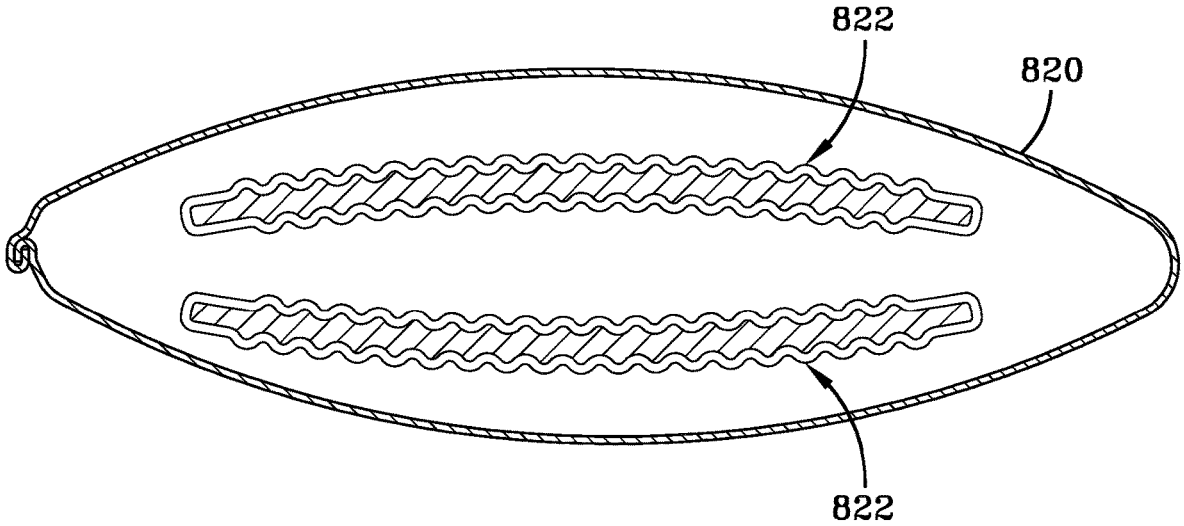
FIG. 31 is a cross-sectional view through an exemplary brush including a pair of exemplary plug strips as shown in FIGS. 27-30.
Figure 32:
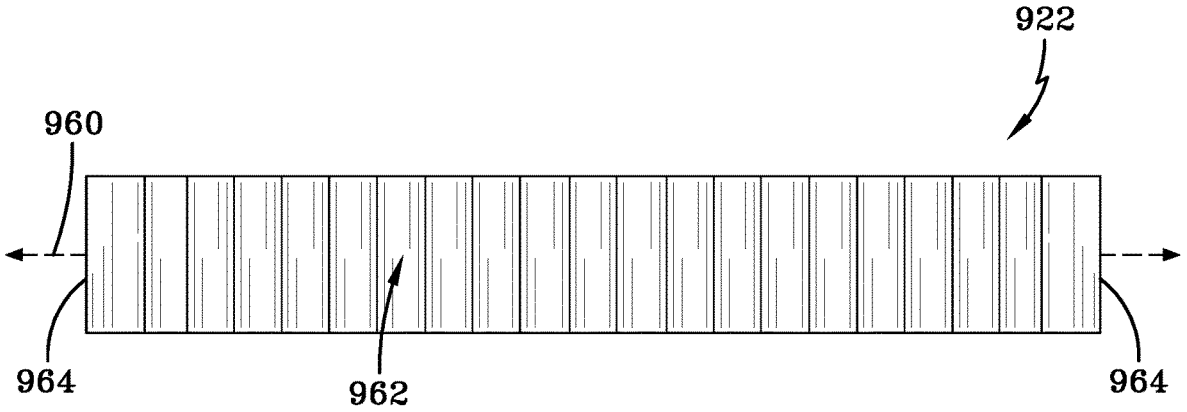
FIG. 32 is a side elevational view of another exemplary plug strip in accordance with the invention.
Figure 33:
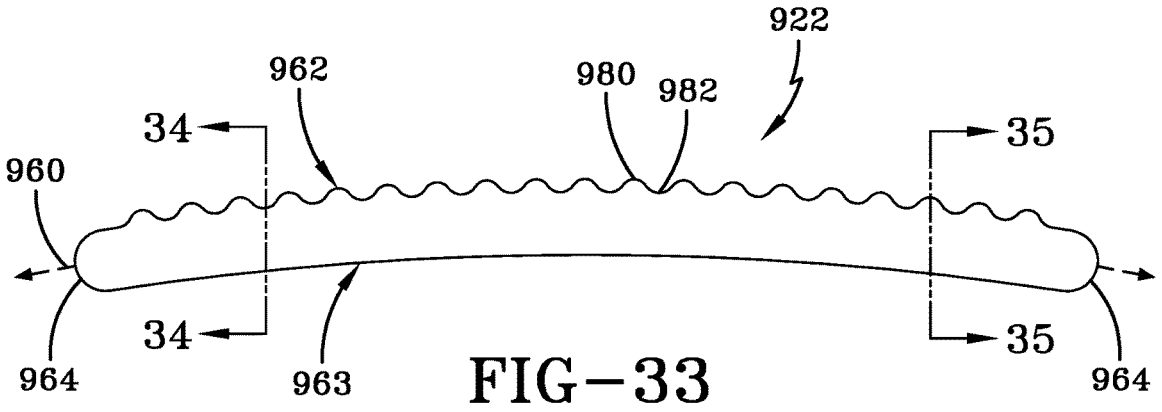
FIG. 33 is a bottom view of the plug strip of FIG. 32.
Figure 34:
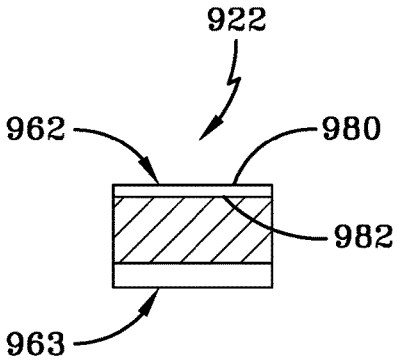
FIG. 34 is a cross-sectional view through the plug strip as shown in FIG. 33.
Figure 35:
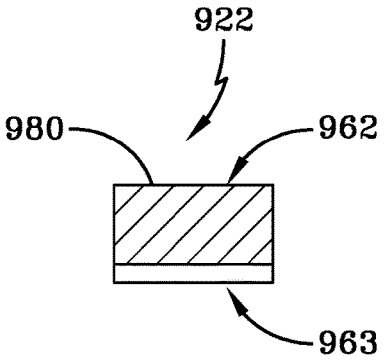
FIG. 35 is another cross-sectional view through the plug strip as shown in FIG. 33.

FIG. 31 depicts a pair of the curved plug strips 822 arranged in an elliptically-shaped ferrule 820 disposed opposite one another and curved in opposite directions relative to one another. In other embodiments, the plug strips may be curved in the same direction.

Turning now to FIGS. 32-36, an embodiment of a plug strip is shown at 922. Like the plug strip 722 of FIGS. 22-26, the plug strip 922 is curved and thus has a curved central strip axis 960 extending between opposed lateral ends 964. The plug strip 922 is further substantially similar to the plug strip 722, except that only a convex side 962 includes alternating ridges and valleys. A concave side 963, disposed opposite the convex side 962, does not include an undulating surface and thus lacks ridges and valleys.

Figure 36:
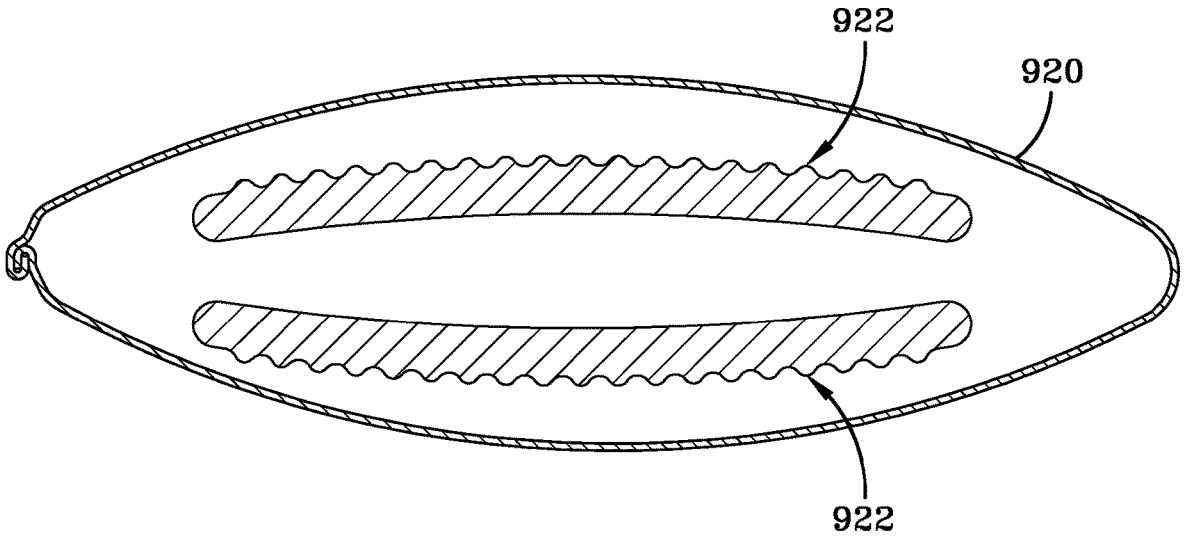
FIG. 36 is a cross-sectional view through an exemplary brush including a pair of exemplary plug strips as shown in FIGS. 32-35.
Figure 37:
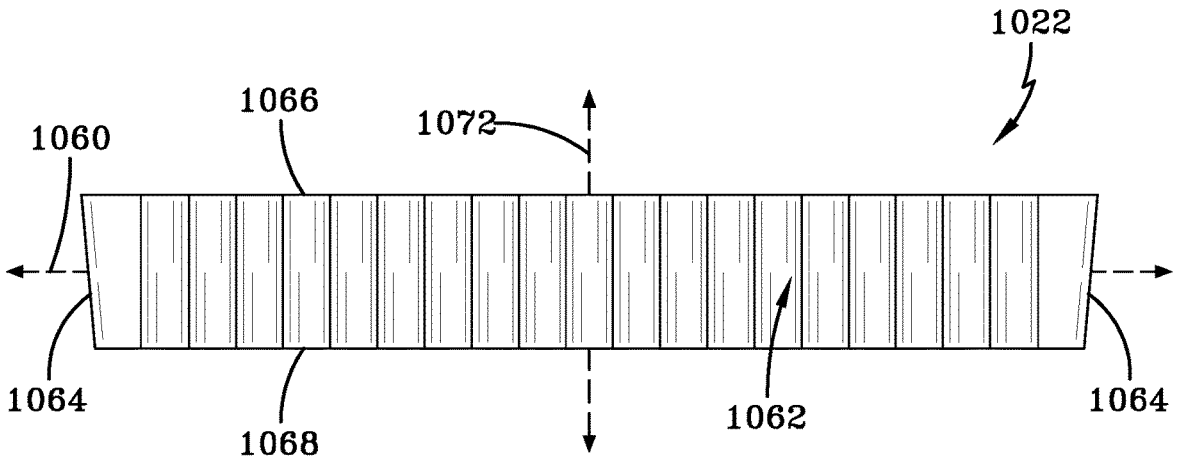
FIG. 37 is a side elevational view of another exemplary plug strip in accordance with the invention.
Figure 38:
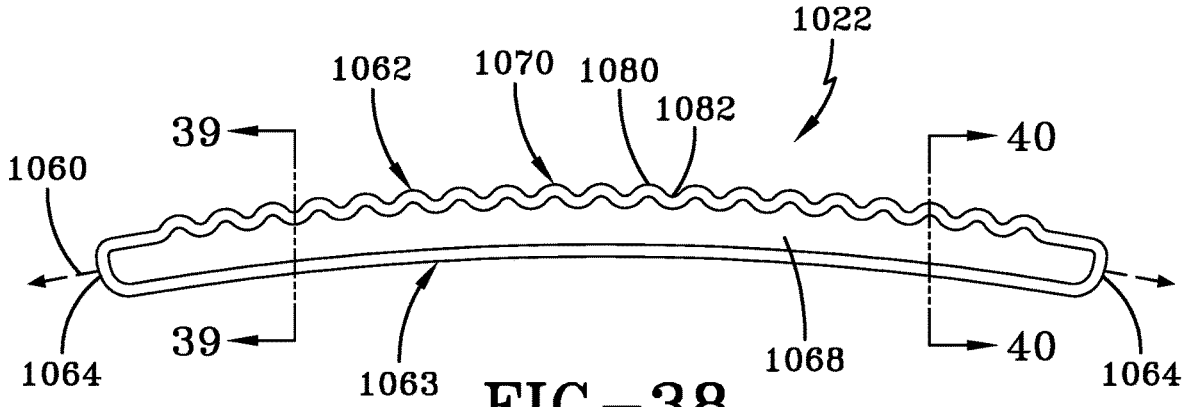
FIG. 38 is a bottom view of the plug strip of FIG. 37.
Figure 39:
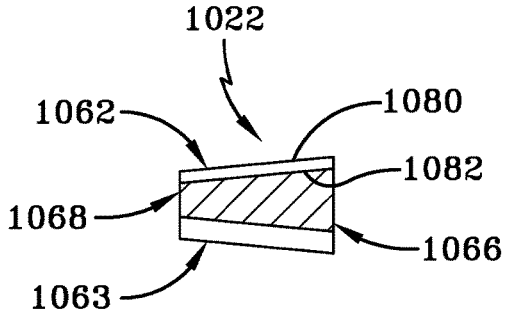
FIG. 39 is a cross-sectional view through the plug strip as shown in FIG. 38.
Figure 40:
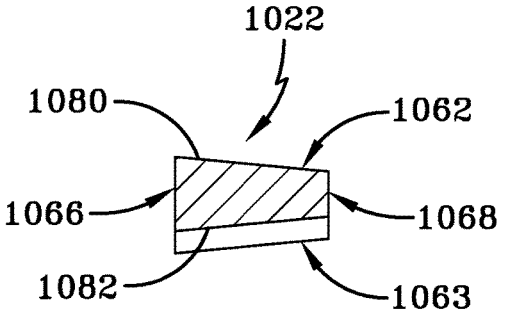
FIG. 40 is another cross-sectional view through the plug strip as shown in FIG. 38.

FIG. 36 depicts a pair of the curved plug strips 922 arranged in an elliptically-shaped ferrule 920 disposed opposite one another and curved in opposite directions relative to one another. The radially inner sides of the pair of plug strips 922 are each the concave sides 963, which do not include an undulating surface.

Turning next to FIGS. 37-41, an embodiment of a plug strip is shown at 1022. Like the plug strip 922 of FIGS. 36-40, the plug strip 1022 is curved and only a convex side 1062 includes alternating ridges and valleys. A concave side 1063, disposed opposite the convex side 1062, does not include an undulating surface and thus lacks ridges and valleys. Additionally, the outer periphery 1070 of the plug strip 1022 tapers outwardly, such as radially outwardly away from a central strip longitudinal axis 1072. For example, the opposed sides 1062 and 1063 and the opposed lateral ends 1064 taper progressively outwardly in a direction from a bottom surface 1068 to a top surface 1066. The ridges 1080 and valleys 1082 also taper progressively outwardly in a direction from the bottom surface 1068 to the top surface 1066.

Figure 41:
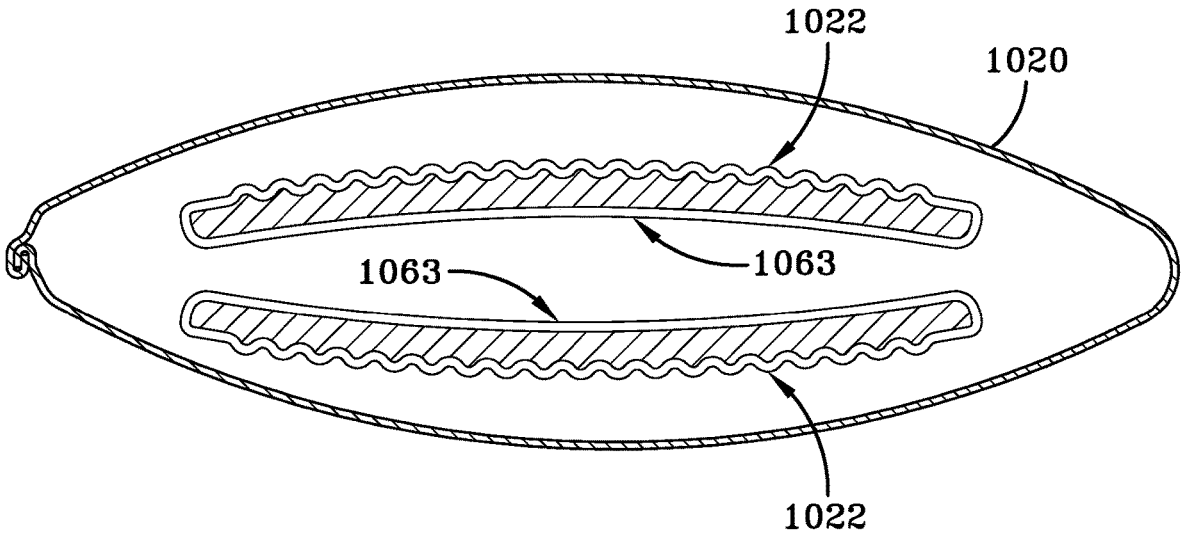
FIG. 41 is a cross-sectional view through an exemplary brush including a pair of exemplary plug strips as shown in FIGS. 37-40.
Figure 42:
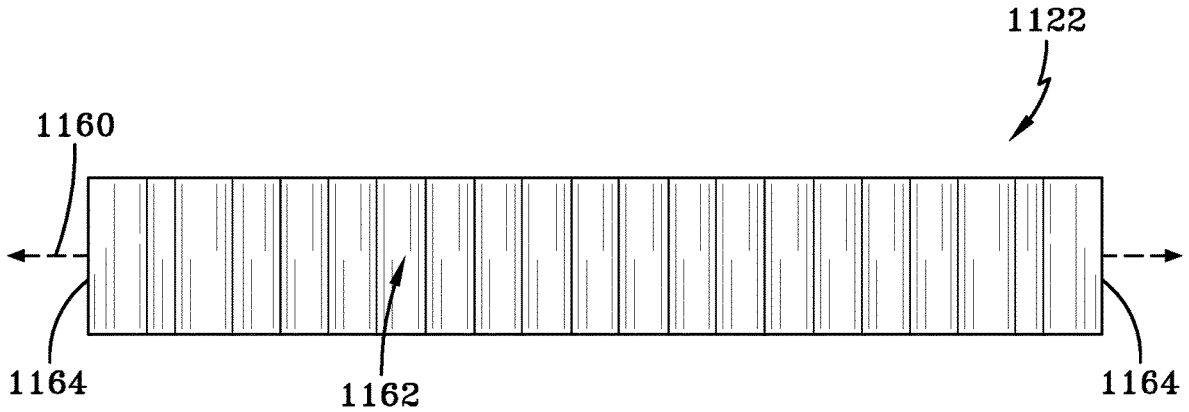
FIG. 42 is a side elevational view of another exemplary plug strip in accordance with the invention.
Figure 43:
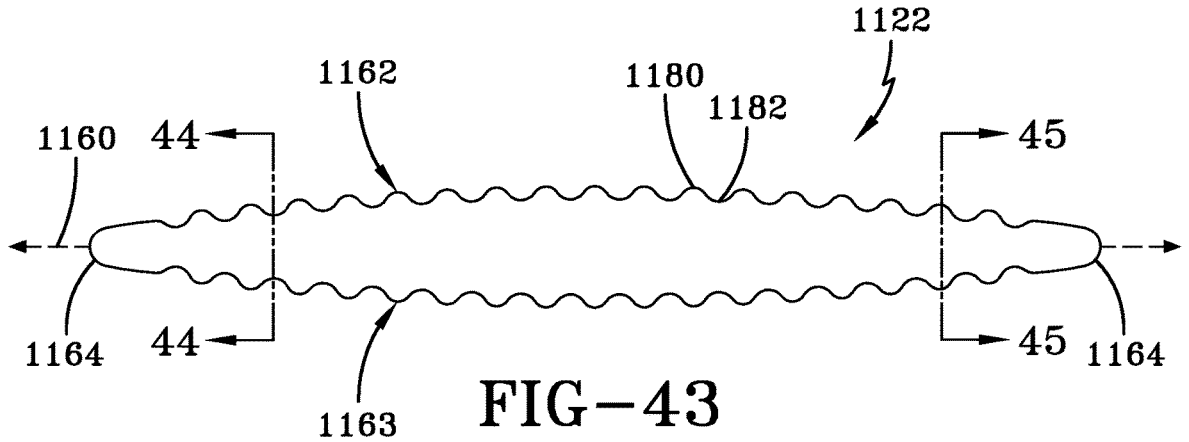
FIG. 43 is a bottom view of the plug strip of FIG. 42.
Figure 44:
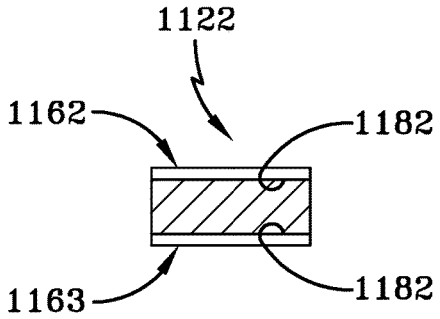
FIG. 44 is a cross-sectional view through the plug strip as shown in FIG. 43.
Figure 45:
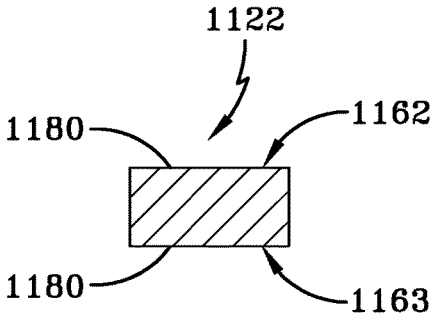
FIG. 45 is another cross-sectional view through the plug strip as shown in FIG. 43.
Figure 46:
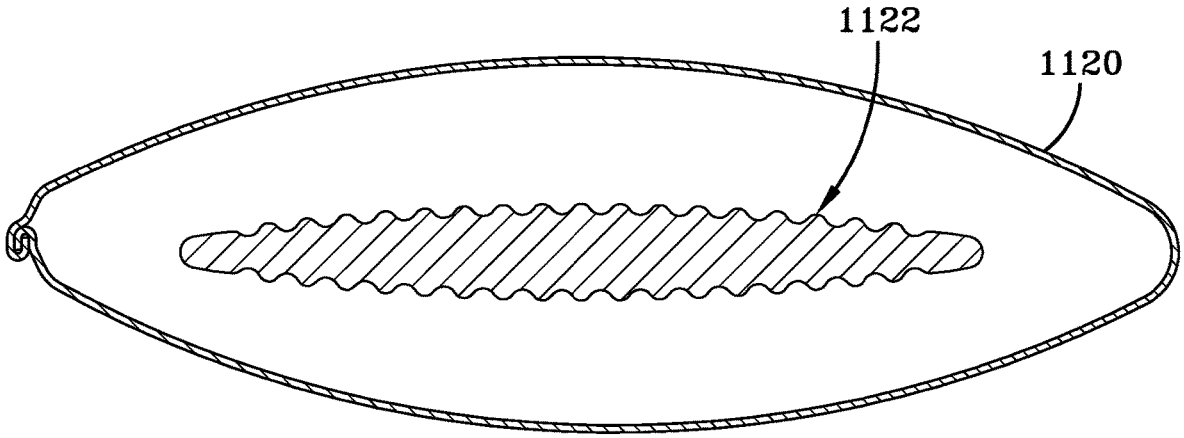
FIG. 46 is a cross-sectional view through an exemplary brush including a pair of exemplary plug strips as shown in FIGS. 42-45.
Figure 47:
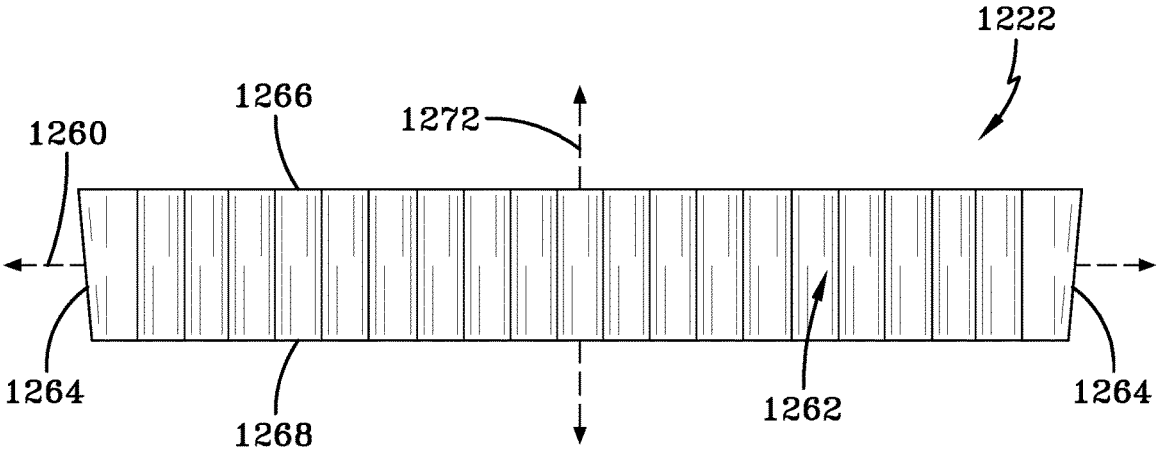
FIG. 47 is a side elevational view of another exemplary plug strip in accordance with the invention.
Figure 48:
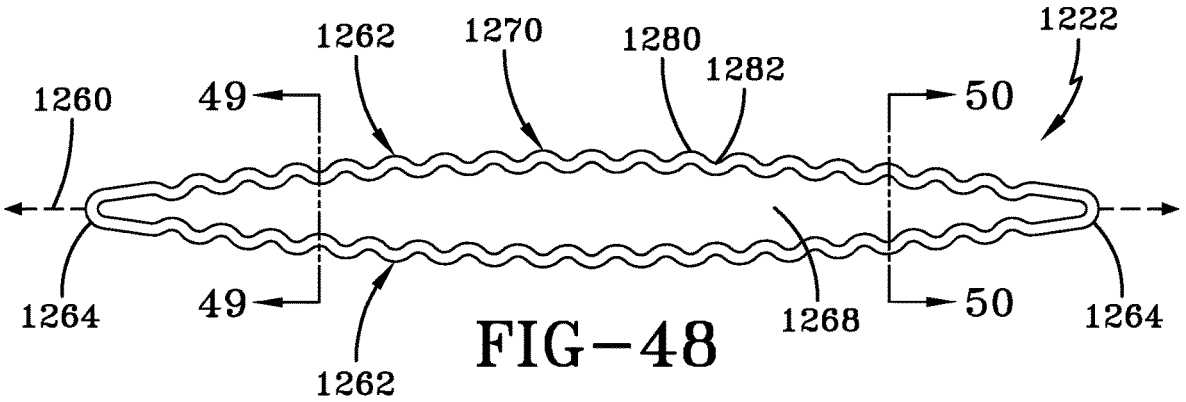
FIG. 48 is a bottom view of the plug strip of FIG. 47.
Figure 49:
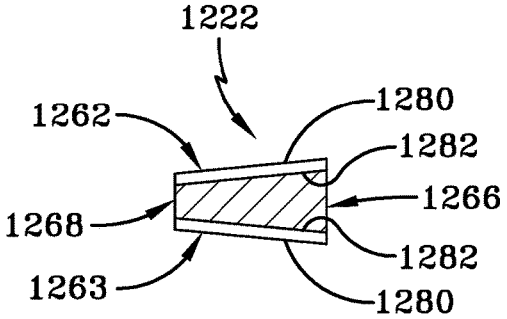
FIG. 49 is a cross-sectional view through the plug strip as shown in FIG. 48.
Figure 50:
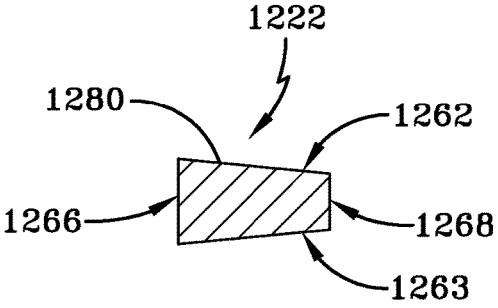
FIG. 50 is another cross-sectional view through the plug strip as shown in FIG. 48.
Figure 51:
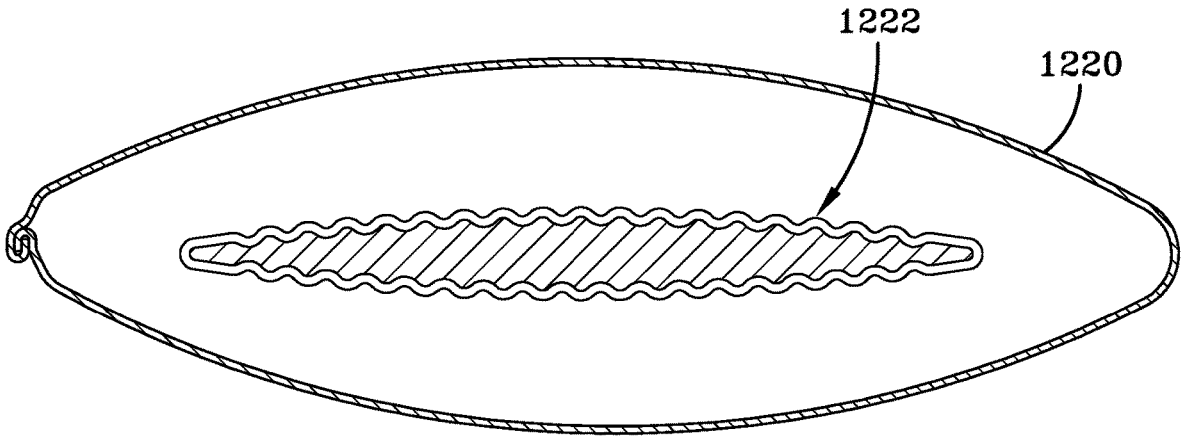
FIG. 51 is a cross-sectional view through an exemplary brush including a pair of exemplary plug strips as shown in FIGS. 47-50.

FIG. 41 depicts a pair of the curved plug strips 1022 arranged in an elliptically-shaped ferrule 1020 disposed opposite one another and curved in opposite directions relative to one another. The radially inner sides of the pair of plug strips 1022 are each the concave sides 1063, which do not include an undulating surface.

With respect to the two embodiments of FIGS. 32-36 and FIGS. 37-41, in other embodiments, any of the radially inner sides and radially outer sides of each of the two plug strips may include an undulating surface. For example, one plug strip may have both opposed sides having an undulating surface while another plug strip may have only a radially inner side or a radially outer side having an undulating surface. Additionally or alternatively, in some embodiments, the plug strips may be curved in the same direction.

Next, with respect to FIGS. 42-46, an embodiment of a plug strip is shown at 1122. The opposing sides 1162 and 1163 are each curved between the opposed lateral ends 1164, but each curve outwardly in opposite directions relative to one another, providing a plug strip 1122 having a generally elliptical shape. Each of the sides 1162 and 1163 includes an undulating surface. A single plug strip 1122 is depicted centered in an elliptical ferule 1120.

Finally, with respect to FIGS. 47-51, an embodiment of a plug strip is shown at 1222. The opposing sides 1262 and 1263 are each curved, but each curve outwardly in opposite directions relative to one another, providing a plug strip 1222 having a generally elliptical shape. Each of the sides 1262 and 1263 includes an undulating surface. Additionally, the outer periphery 1270 of the plug strip 1222 tapers outwardly, such as radially outwardly away from a central strip longitudinal axis 1272. For example, the opposed sides 1262 and 1263 and the opposed lateral ends 1264 taper progressively outwardly in a direction from a bottom surface 1268 to a top surface 1266. The ridges 1280 and valleys 1282 also taper progressively outwardly in a direction from the bottom surface 1268 to the top surface 1266. A single plug strip 1222 is depicted centered in an elliptical ferule 1220.

With respect to the two embodiments of FIGS. 42-46 and FIGS. 47-51, in other embodiments, a pair of plug strips may be included. In such case, any of the radially inner sides and radially outer sides of each of the two plug strips may include an undulating surface. For example, one plug strip may have both opposed sides having an undulating surface while another plug strip may have only a radially inner side or a radially outer side having an undulating surface. Additionally or alternatively, in some embodiments, the plug strips may be curved in the same direction.

With respect to any of the tapered plug strips 822, 1022 and 1222, in even other embodiments, a full outer periphery of a plug strip may not be tapered. For example, one or more but not all of the opposed sides and opposed lateral ends of a plug strip may be tapered in a direction between a top and bottom surface and/or in a direction between opposed lateral ends.

In summary, a brush 10, 110 of the present disclosure includes a handle 12 a plurality of bristles 14, 114, and a sleeve 20, 120 configured to couple the plurality of bristles 14, 114 to the handle 12. A plug strip 22, 122, 222, 322, 422, 522, 622, 722, 822, 922, 1022, 1122, 1222 is disposed within the sleeve 20, 120, 720, 820, 920, 1020, 1120, 1220 and may be configured to orient the plurality of bristles 14, 114 to provide increased coating performance. The plug strip 22, 122, 222, 322, 422, 522, 622, 722, 822, 922, 1022, 1122, 1222 has opposed sides 62, 162, 262, 362, 462, 562, 662, 762, 862, 962, 1062, 1162, 1262 extending along a central strip longitudinal axis 60, 160, 260, 360, 460, 560, 660, 760, 860, 960, 1060, 1160, 1260 of the plug strip 22, 122, 222, 322, 422, 522, 622, 722, 822, 922, 1022, 1122, 1222. At least one of the opposed sides 62, 162, 262, 362, 462, 562, 662, 762, 862, 962, 1062, 1162, 1262 has an undulating surface forming tapered ridges 80, 180, 280, 380, 480, 580, 680, 780, 880, 980, 1080, 1180, 1280 alternating with tapered valleys 82, 182, 282, 382, 482, 582, 682, 782, 882, 982, 1082, 1182, 1282.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A brush comprising:

a handle;

a plurality of bristles extending from a proximal bristle end region to a distal bristle end region;

a sleeve disposed about the proximal bristle end region of the plurality of bristles and configured to couple the plurality of bristles to the handle; and a plug strip disposed within the sleeve and spaced inwardly from the sleeve to form a region in which the proximal bristle end region of the plurality of bristles is retained, wherein the plug strip has opposed sides, and wherein at least one of the opposed sides has an undulating surface forming tapered ridges alternating with tapered valleys in which end portions of the bristles are retained.

2. The brush of claim 1, wherein each of the opposed sides has an undulating surface forming tapered ridges alternating with tapered valleys in which end portions of the bristles are retained.

3. The brush of claim 2, wherein the strip extends between opposed rounded end portions each having a width greater than spacing between the valleys on opposite sides of the plug strip.

4. The brush of claim 1, wherein the opposed sides extend along a central strip longitudinal axis of the plug strip, and wherein the valleys have widths along the central strip longitudinal axis that become progressively smaller in a direction from a location at one half depth of the valleys inwardly towards the central strip longitudinal axis.

5. The brush of claim 1, wherein the ridges and the valleys are rounded.

6. The brush of claim 1, wherein a pitch between the valleys is no greater than a pitch between the ridges.

7. The brush of claim 1, wherein the opposed sides extend along a central strip longitudinal axis of the plug strip, and wherein the alternating ridges and valleys extend fully along the opposed sides along the central strip longitudinal axis.

8. The brush of claim 1, wherein the plug strip includes opposed top and bottom surfaces, and wherein the alternating ridges and valleys extend fully between the opposed top and bottom surfaces.

9. The brush of claim 1, wherein the brush includes a central brush longitudinal axis extending from the proximal bristle end region to the distal bristle end region, and wherein a full outer periphery of the plug strip extending about the central brush longitudinal axis is radially inwardly spaced from a radially inner surface of the sleeve disposed about the plug strip.

10. The brush of claim 1, wherein the brush includes a central brush longitudinal axis extending from the proximal bristle end region to the distal bristle end region, and wherein the ridges and valleys all extend along and align with the central brush longitudinal axis.

11. The brush of claim 1, wherein the ridges are equally spaced from one another.

12. The brush of claim 1, wherein the plug strip extends along the central strip longitudinal axis between opposed lateral ends of the plug strip, and wherein each of the opposed lateral ends forms a single rounded ridge extending outwardly from the opposed sides.

13. The brush of claim 1, wherein the plug strip is a first plug strip and further including a second plug strip disposed within the sleeve and spaced inwardly from the sleeve, the second plug strip disposed parallel to and spaced from the first plug strip, wherein the second plug strip has opposed sides, and wherein at least one of the opposed sides of the second plug strip has an undulating surface forming tapered ridges alternating with tapered valleys in which end portions of the bristles are retained.

14. The brush of claim 13, wherein the first and second plug strips each have a radially outer opposed side that faces away from the other of the first and second plug strips, and wherein the radially outer opposed side of each of the first and second plug strips has the undulating surface.

15. A brush comprising:

a handle;

a plurality of bristles extending from a proximal bristle end region to a distal bristle end region;

a sleeve disposed about the proximal bristle end region of the plurality of bristles and configured to couple the plurality of bristles to the handle; and a plug strip disposed within the sleeve and spaced inwardly from the sleeve to from a region in which the proximal bristle end region of the plurality of bristles is retained, wherein the plug strip has opposed sides and at least one of the opposed sides has an undulating surface forming ridges alternating with valleys in which end portions of the bristles are retained, and wherein a pitch between the valleys is no greater than a pitch between the ridges; and wherein the valleys and the ridges are rounded.

16. A brush comprising:

a handle;

a plurality of bristles extending from a proximal bristle end region to a distal bristle end region;

a sleeve disposed about the proximal bristle end region of the plurality of bristles and configured to couple the plurality of bristles to the handle; and a plug strip disposed within the sleeve and spaced inwardly from the sleeve to form a region in which the proximal bristle end region of the plurality of bristles is retained, wherein the plug strip has opposed sides each having an undulating surface forming ridges alternating with valleys in which end portions of the bristles are retained, wherein the plug strip extends between opposed rounded end portions each having a width greater than spacing between the valleys on opposite sides of the plug strip.

17. A plug strip for being spaced inwardly from a sleeve of a brush to form a region in which bristle end regions of a plurality of bristles may be retained, the plug strip comprising:

opposed sides each having an undulating surface forming ridges alternating with valleys in which end portions of the bristles may be retained, wherein the plug strip is characterized by at least one of the additional features of (a) the ridges and valleys being tapered, or (b) the plug strip extending between opposed rounded end portions each having a width greater than spacing between the valleys on opposite sides of the plug strip.

* * * * *